US008922536B2

(12) United States Patent
Sugimoto et al.

(10) Patent No.: US 8,922,536 B2
(45) Date of Patent: Dec. 30, 2014

(54) METHOD FOR DRIVING DISPLAY ELEMENT AND METHOD FOR DRIVING DISPLAY DEVICE

(71) Applicant: Sony Corporation, Tokyo (JP)

(72) Inventors: Hideki Sugimoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 2 days.

(21) Appl. No.: 13/894,663

(22) Filed: May 15, 2013

(65) Prior Publication Data

US 2013/0249888 A1 Sep. 26, 2013

Related U.S. Application Data

(62) Division of application No. 12/729,640, filed on Mar. 23, 2010, now Pat. No. 8,525,758.

(30) Foreign Application Priority Data

Apr. 1, 2009 (JP) ..... 2009-089063

(51) Int. Cl.
*G09G 5/00* (2006.01)
*G09G 3/32* (2006.01)

(52) U.S. Cl.
CPC ..... *G09G 5/001* (2013.01); *G09G 3/3291* (2013.01); *G09G 2300/0819* (2013.01); *G09G 2300/0866* (2013.01); *G09G 3/3233* (2013.01)
USPC ..... 345/204; 345/76

(58) Field of Classification Search
USPC ..... 345/204
See application file for complete search history.

(56) References Cited

U.S. PATENT DOCUMENTS

| | | | | |
|---|---|---|---|---|
| 2005/0083270 | A1 | 4/2005 | Miyazawa | |
| 2005/0206590 | A1 | 9/2005 | Sasaki et al. | |
| 2005/0269959 | A1 | 12/2005 | Uchino et al. | |
| 2006/0176250 | A1 | 8/2006 | Nathan et al. | |
| 2007/0115225 | A1* | 5/2007 | Uchino et al. | 345/76 |
| 2007/0268210 | A1 | 11/2007 | Uchino et al. | |
| 2007/0273621 | A1* | 11/2007 | Yamashita et al. | 345/76 |
| 2008/0238830 | A1* | 10/2008 | Iida et al. | 345/76 |

FOREIGN PATENT DOCUMENTS

JP 2007-310311 11/2007

* cited by examiner

*Primary Examiner* — Jonathan Boyd
(74) *Attorney, Agent, or Firm* — Dentons US LLP

(57) ABSTRACT

Disclosed herein is a method for driving a display element including a current-driven light emitting part and a drive circuit, the drive circuit including a write transistor, a drive transistor, and a capacitive part, the method including the steps of: executing threshold voltage cancel processing of changing potential of the second node toward potential obtained by subtracting threshold voltage of the drive transistor from potential of the first node in a state in which the potential of the first node is kept; and executing write processing of applying a video signal from the data line to the first node via the write transistor turned to an on-state by a scan signal from the scan line.

6 Claims, 18 Drawing Sheets

[TP(2)$_{-1}$]

[TP(2)$_0$]

[TP(2)$_{1A}$]

[TP(2)$_{1B}$]

[TP(2)$_2$]

[TP(2)$_3$]

[TP(2)$_4$]

[TP(2)$_5$]

[TP(2)$_{6A}$]

[TP(2)$_{6B}$]

[TP(2)$_{6C}$]

[TP(2)$_7$]

[TP(2)$_5$]

[TP(2)$_{6A}$]

[TP(2)$_{6B}$]

[TP(2)$_{6C}$]

[TP(2)$_7$]

METHOD FOR DRIVING DISPLAY ELEMENT AND METHOD FOR DRIVING DISPLAY DEVICE

RELATED APPLICATION DATA

This application is a division of U.S. patent application Ser. No. 12/729,640 filed Mar. 23, 2010, the entirety of which is incorporated herein by reference to the extent permitted by law. The present application claims the benefit of priority to Japanese Patent Application No. JP 2009-089063 filed on Apr. 1, 2009 in the Japan Patent Office, the entirety of which is incorporated by reference herein to the extent permitted by law.

BACKGROUND OF THE INVENTION

1. Field of the Invention

The present invention relates to a method for driving a display element and a method for driving a display device.

2. Description of the Related Art

A display element including a current-driven light emitting part and a display device including the display element are known. For example, a display element including an organic electroluminescence (hereinafter, it will be often abbreviated as EL) light emitting part based on the electroluminescence of an organic material (hereinafter, this display element will be often abbreviated simply as the organic EL display element) is attracting attention as a display element capable of high-luminance light emission by low-voltage DC driving.

Similarly to the liquid crystal display device, also for e.g. a display device including the organic EL display element (hereinafter, this display device will be often abbreviated simply as the organic EL display device), the simple-matrix system and the active-matrix system are known as the driving system. The active-matrix system has advantages of being capable of offering high image luminance and so on, although having a defect that the structure is complex. The organic EL display element driven by the active-matrix system includes a light emitting part composed of an organic layer and so on including a light emitting layer and a drive circuit for driving the light emitting part.

As a circuit for driving the organic electroluminescence light emitting part (hereinafter, it will be often referred to simply as the light emitting part), a drive circuit including two transistors and one capacitive part (referred to as the 2Tr/1C drive circuit) is known from e.g. Japanese Patent Laid-open No. 2007-310311. As shown in FIG. 2, this 2Tr/1C drive circuit includes two transistors, a write transistor $TR_W$ and a drive transistor $TR_D$, and further includes one capacitive part $C_1$. The other source/drain region of the drive transistor $TR_D$ forms a second node $ND_2$, and the gate electrode of the drive transistor $TR_D$ forms a first node $ND_1$.

The cathode electrode of a light emitting part ELP is connected to a second power feed line PS2 that is common. A voltage $V_{Cat}$ (e.g. 0 volt) is applied to the second power feed line PS2.

As shown in a timing chart of FIG. 6, pre-processing for executing threshold voltage cancel processing is executed in [period-TP(2)$_{1A}$]. Specifically, a first node initialization voltage $V_{Ofs}$ (e.g. 0 volt) is applied from a data line DTL to the first node $ND_1$ via the write transistor $TR_W$ turned to the on-state by a scan signal from a scan line SCL. Thereby, the potential of the first node $ND_1$ becomes $V_{Ofs}$. Furthermore, a second node initialization voltage $V_{CC-L}$ (e.g. −10 volts) is applied from a power supply unit 100 to the second node $ND_2$ via the drive transistor $TR_D$. Thereby, the potential of the second node $ND_2$ becomes $V_{CC-L}$. The threshold voltage of the drive transistor $TR_D$ is represented as the voltage $V_{th}$ (e.g. 3 volts). The potential difference between the gate electrode of the drive transistor $TR_D$ and the other source/drain region (hereinafter, it will be often referred to as the source region, for convenience) thereof is equal to or larger than $V_{th}$, and the drive transistor $TR_D$ is in the on-state.

Subsequently, the threshold voltage cancel processing is executed over the period from [period-TP(2)$_{1B}$] to [period-TP(2)$_5$]. Specifically, the first threshold voltage cancel processing is executed in [period-TP(2)$_{1B}$]. The second threshold voltage cancel processing is executed in [period-TP(2)$_3$]. The third threshold voltage cancel processing is executed in [period-TP(2)$_5$].

In [period-TP(2)$_{1B}$], the voltage of the power supply unit 100 is switched from the second node initialization voltage $V_{CC-L}$ to a drive voltage $V_{CC-H}$ (e.g. 20 volts), with the on-state of the write transistor $TR_W$ kept. As a result, the potential of the second node $ND_2$ changes toward the potential obtained by subtracting the threshold voltage $V_{th}$ of the drive transistor $TR_D$ from the potential of the first node $ND_1$. That is, the potential of the second node $ND_2$ rises.

If this [period-TP(2)$_{1B}$] is sufficiently long, the potential difference between the gate electrode of the drive transistor $TR_D$ and the other source/drain region thereof reaches $V_{th}$, and the drive transistor $TR_D$ enters the off-state. Specifically, the potential of the second node $ND_2$ comes close to ($V_{Ofs}-V_{th}$) and finally becomes ($V_{Ofs}-V_{th}$). However, in the example shown in FIG. 6, the length of [period-TP(2)$_{1B}$] is not enough to sufficiently change the potential of the second node $ND_2$. Therefore, at the end timing of [period-TP(2)$_{1B}$], the potential of the second node $ND_2$ reaches a certain potential $V_1$ that satisfies the relationship $V_{CC-L}<V_1<(V_{Ofs}-V_{th})$.

At the start timing of [period-TP(2)$_2$], the voltage of the data line DTL is switched from the first node initialization voltage $V_{Ofs}$ to a video signal $V_{Sig_m-2}$. In order to prevent the video signal $V_{Sig_m-2}$ from being applied to the first node $ND_1$, the write transistor $TR_W$ is turned to the off-state by the signal from the scan line SCL at the start timing of this [period-TP(2)$_2$]. As a result, the first node $ND_1$ becomes the floating state.

Because the drive voltage $V_{CC-H}$ is applied from the power supply unit 100 to one source/drain region of the drive transistor $TR_D$, the potential of the second node $ND_2$ rises from the potential $V_1$ to a certain potential $V_2$. On the other hand, the gate electrode of the drive transistor $TR_D$ is in the floating state, and the capacitive part $C_1$ exists. Thus, bootstrap operation occurs at the gate electrode of the drive transistor $TR_D$. Consequently, the potential of the first node $ND_1$ rises in the wake of the potential change of the second node $ND_2$.

At the start timing of [period-TP(2)$_3$], the voltage of the data line DTL is switched from the video signal $V_{Sig_m-2}$ to the first node initialization voltage $V_{Ofs}$. At the start timing of this [period-TP(2)$_3$], the write transistor $TR_W$ is turned to the on-state by the signal from the scan line SCL. As a result, the potential of the first node $ND_1$ becomes $V_{Ofs}$. Furthermore, the drive voltage $V_{CC-H}$ is applied from the power supply unit 100 to one source/drain region of the drive transistor $TR_D$. As a result, the potential of the second node $ND_2$ changes toward the potential obtained by subtracting the threshold voltage $V_{th}$ of the drive transistor $TR_D$ from the potential of the first node $ND_1$. That is, the potential of the second node $ND_2$ rises from the potential $V_2$ to a certain potential $V_3$.

At the start timing of [period-TP(2)$_4$], the voltage of the data line DTL is switched from the first node initialization voltage $V_{Ofs}$ to a video signal $V_{Sig_m-1}$. In order to prevent the video signal $V_{Sig_m-1}$ from being applied to the first node $ND_1$, the write transistor $TR_W$ is turned to the off-state by the signal from the scan line SCL at the start timing of this [period-TP(2)$_4$]. As a result, the first node $ND_1$ becomes the floating state.

Because the drive voltage $V_{CC-H}$ is applied from the power supply unit 100 to one source/drain region of the drive transistor $TR_D$, the potential of the second node $ND_2$ rises from the potential $V_3$ to a certain potential $V_4$. On the other hand, the gate electrode of the drive transistor $TR_D$ is in the floating state, and the capacitive part $C_1$ exists. Thus, bootstrap operation occurs at the gate electrode of the drive transistor $TR_D$. Consequently, the potential of the first node $ND_1$ rises in the wake of the potential change of the second node $ND_2$.

As the premise of the operation in [period-TP(2)$_5$], it is necessary that the potential $V_4$ of the second node $ND_2$ be lower than $(V_{Ofs}-V_{th})$ at the start timing of [period-TP(2)$_5$]. The length from the start timing of [period-TP(2)$_{1B}$] to the start timing of [period-TP(2)$_5$] is so decided that the condition $V_4<(V_{Ofs}-V_{th})$ is satisfied.

The operation in [period-TP(2)$_5$] is basically the same as the above-described operation in [period-TP(2)$_3$]. At the start timing of this [period-TP(2)$_5$], the voltage of the data line DTL is switched from the video signal $V_{Sig_m-1}$ to the first node initialization voltage $V_{Ofs}$. At the start timing of this [period-TP(2)$_5$], the write transistor $TR_W$ is turned to the on-state by the signal from the scan line SCL.

The first node $ND_1$ becomes the state in which the first node initialization voltage $V_{Ofs}$ is applied thereto from the data line DTL via the write transistor $TR_W$. Furthermore, the drive voltage $V_{CC-H}$ is applied from the power supply unit 100 to one source/drain region of the drive transistor $TR_D$. Similarly to the above-described operation in [period-TP(2)$_3$], the potential of the second node $ND_2$ changes toward the potential obtained by subtracting the threshold voltage $V_{th}$ of the drive transistor $TR_D$ from the potential of the first node $ND_1$. If the potential difference between the gate electrode of the drive transistor $TR_D$ and the other source/drain region thereof reaches $V_{th}$, the drive transistor $TR_D$ becomes the off-state. In this state, the potential of the second node $ND_2$ is substantially $(V_{Ofs}-V_{th})$.

Thereafter, in [period-TP(2)$_{6A}$], the write transistor $TR_W$ is set to the off-state. Furthermore, the voltage of the data line DTL is set to the voltage corresponding to the video signal [video signal (drive signal, luminance signal) $V_{Sig_m}$ for controlling the luminance of the light emitting part ELP].

Subsequently, write processing is executed in [period-TP(2)$_{6B}$]. Specifically, the write transistor $TR_W$ is turned to the on-state by switching the scan line SCL to the high level. As a result, the potential of the first node $ND_1$ rises toward the video signal $V_{Sig_m}$.

Here, the capacitance of the capacitive part $C_1$ is defined as the value $c_1$, and the value of the capacitance $C_{EL}$ of the light emitting part ELP is defined as the value $c_{EL}$. Furthermore, the value of the parasitic capacitance between the gate electrode of the drive transistor $TR_D$ and the other source/drain region thereof is defined as $c_{gs}$. If the capacitance between the first node $ND_1$ and the second node $ND_2$ is represented by sign $c_A$, $c_A=c_1+c_{gs}$ holds. If the capacitance between the second node $ND_2$ and the second power feed line PS2 is represented by sign $c_B$, $c_B=c_{EL}$ holds.

When the potential of the gate electrode of the drive transistor $TR_D$ changes from $V_{Ofs}$ to $V_{Sig_m}$ ($>V_{Ofs}$), the voltage between the first node $ND_1$ and the second node $ND_2$ changes. Specifically, the charge based on the change in the potential of the gate electrode of the drive transistor $TR_D$ (=the potential of the first node $ND_1$) $(V_{Sig_m}-V_{Ofs})$ is distributed depending on the capacitance between the first node $ND_1$ and the second node $ND_2$ and the capacitance between the second node $ND_2$ and the second power feed line PS2. However, the potential change of the second node $ND_2$ is small if the value $c_B$ ($=c_{EL}$) is sufficiently larger than the value $c_A$ ($=c_1+c_{gs}$). In general, the value $c_{EL}$ of the capacitance $C_{EL}$ of the light emitting part ELP is larger than the value $c_1$ of the capacitive part $C_1$ and the value $c_{gs}$ of the parasitic capacitance of the drive transistor $TR_D$. For convenience, hereinafter, the description will be made without taking into consideration the potential change of the second node $ND_2$ arising due to the potential change of the first node $ND_1$.

In the above-described operation, the video signal $V_{Sig_m}$, is applied to the gate electrode of the drive transistor $TR_D$ in the state in which the drive voltage $V_{CC-H}$ is applied from the power supply unit 100 to one source/drain region of the drive transistor $TR_D$. Therefore, as shown in FIG. 6, the potential of the second node $ND_2$ rises in [period-TP(2)$_{6B}$]. The amount $\Delta V$ of rise of the potential (potential correction value) will be described later. If the potential of the gate electrode of the drive transistor $TR_D$ (first node $ND_1$) is defined as $V_g$ and the potential of the other source/drain region thereof (second node $ND_2$) is defined as $V_s$, the value of $V_g$ and the value of $V_s$ are as follows unless the above-described amount $\Delta V$ of rise of the potential of the second node $ND_2$ is not taken into consideration. The potential difference between the first node $ND_1$ and the second node $ND_2$, i.e. the potential difference $V_{gs}$ between the gate electrode of the drive transistor $TR_D$ and the other source/drain region thereof serving as the source region, can be represented by the following Formula (A).

$$V_g=V_{Sig_m}$$

$$V_s\approx V_{Ofs}-V_{th}$$

$$V_{gs}\approx V_{Sig_m}-(V_{Ofs}-V_{th}) \quad \text{(A)}$$

That is, $V_{gs}$ obtained through the write processing for the drive transistor $TR_D$ depends only on the video signal $V_{Sig_m}$ for controlling the luminance of the light emitting part ELP, the threshold voltage $V_{th}$ of the drive transistor $TR_D$, and the voltage $V_{Ofs}$ for initializing the potential of the gate electrode of the drive transistor $TR_D$. Furthermore, $V_{gs}$ has no relation to the threshold voltage $V_{th\text{-}EL}$ of the light emitting part ELP.

Next, a simple description will be made about mobility correction processing. In the above-described operation, in conjunction with the write processing, the mobility correction processing of changing the potential of the other source/drain region of the drive transistor $TR_D$ (i.e. the potential of the second node $ND_2$) depending on a characteristic of the drive transistor $TR_D$ (e.g. the magnitude of the mobility p) is also executed.

As described above, the video signal $V_{Sig_m}$ is applied to the gate electrode of the drive transistor $TR_D$ in the state in which the drive voltage $V_{CC-H}$ is applied from the power supply unit 100 to one source/drain region of the drive transistor $TR_D$. As shown in FIG. 6, the potential of the second node $ND_2$ rises in [period-TP(2)$_{6B}$]. As a result, if the value of the mobility $\mu$ of the drive transistor $TR_D$ is large, the amount $\Delta V$ of rise (potential correction value) of the potential of the source region of the drive transistor $TR_D$ is large. If the value of the mobility $\mu$ of the drive transistor $TR_D$ is small, the amount $\Delta V$ of rise (potential correction value) of the potential of the source region of the drive transistor $TR_D$ is small. The potential difference $V_{gs}$ between the gate electrode of the drive transistor $TR_D$ and the source region thereof is transformed from that by Formula (A) to that by the following Formula (B).

$$V_{gs}\approx V_{Sig_m}-(V_{Ofs}-V_{th})-\Delta V \quad \text{(B)}$$

Through the above-described operation, the threshold voltage cancel processing, the write processing, and the mobility correction processing are completed. At the start timing of the subsequent [period-TP(2)$_{6C}$], the first node $ND_1$ is turned to the floating state by switching the write transistor $TR_W$ to the off-state by the scan signal from the scan line SCL. The drive voltage $V_{CC-H}$ is applied from the power supply unit 100 to one source/drain region (hereinafter, it will be often referred to as the drain region, for convenience) of the drive transistor $TR_D$. As a result of the above operation, the potential of the second node $ND_2$ rises, and a phenomenon similar to one in a so-called bootstrap circuit occurs at the gate electrode of the drive transistor $TR_D$, so that the potential of the first node $ND_1$ also rises. The potential difference $V_{gs}$ between the gate electrode of the drive transistor $TR_D$ and the source region thereof keeps the value of Formula (B). The current flowing through the light emitting part ELP is a drain current $I_{ds}$ that flows from the drain region of the drive transistor $TR_D$ to the source region thereof. If the drive transistor $TR_D$ ideally operates in the saturation region, the drain current $I_{ds}$ can be represented by the following Formula (C). The light emitting part ELP emits light with the luminance dependent on the value of the drain current $I_{ds}$. Details of the coefficient k will be described later.

$$I_{ds} = k \cdot \mu \cdot (V_{gs} - V_{th})^2 = k \cdot \mu \cdot (V_{Sig_m} - V_{Ofs} - \Delta V)^2 \quad \text{(C)}$$

According to Formula (C), the drain current $I_{ds}$ is proportional to the mobility μ. For the drive transistor $TR_D$ having higher mobility μ, the potential correction value ΔV is larger and the value of $(V_{Sig_m}-V_{Ofs}-\Delta V)^2$ in Formula (C) is smaller. This allows correction of variation in the drain current $I_{ds}$ attributed to variation in the mobility μ of the drive transistor.

The operation of the 2Tr/1C drive circuit, whose outline has been described above, will also be described in detail later.

SUMMARY OF THE INVENTION

As described above, the potential change of the first node $ND_1$ between [period-TP(2)$_{6A}$] and [period-TP(2)$_{6B}$] is $(V_{Sig_m}-V_{Ofs})$. In the above description, the potential change of the second node $ND_2$ arising due to the potential change of the first node $ND_1$ is not taken into consideration. However, in practice, the potential change given by $(V_{Sig_m}-V_{Ofs})\cdot c_A/(c_A+c_B)$ basically occurs at the second node $ND_2$, and the potential difference between the first node $ND_1$ and the second node $ND_2$ decreases. As a result, the above-described Formula (C) is transformed as follows.

$$I_{ds}=k\cdot\mu\cdot(\alpha\cdot(V_{Sig_m}-V_{Ofs})-\Delta V)^2 \quad \text{(C')}$$

wherein $\alpha=1-c_A/(c_A+c_B)$

The $c_A/(c_A+c_B)$ possibly takes a value in the range of about 0.1 to 0.4 although depending on the specifications of the display element. Therefore, the current that flows to the light emitting part ELP in [period-TP(2)$_{6C}$] and the subsequent periods decreases, and thus the luminance of the light emitting part ELP is also lowered. It may be possible to employ a countermeasure of setting the amplitude of the video signal Vsig large in advance to cover the luminance lowering. However, this countermeasure leads to a problem that increase in the power consumption is caused by the amplitude enlargement of the video signal Vsig.

There is a need for the present invention to provide a method for driving a display element and a method for driving a display device, each capable of suppressing the potential change of the second node $ND_2$ arising due to the potential change of the first node $ND_1$.

According to a first form of the present invention, there is provided a method for driving a display element including a current-driven light emitting part and a drive circuit.

The drive circuit includes a write transistor, a drive transistor, and a capacitive part.

In the display element, (A-1) one source/drain region of the drive transistor is connected to a first power feed line, (A-2) the other source/drain region of the drive transistor is connected to the anode electrode included in the light emitting part and one electrode of the capacitive part, and forms a second node, (A-3) the gate electrode of the drive transistor is connected to the other source/drain region of the write transistor and the other electrode of the capacitive part, and forms a first node, (B-1) one source/drain region of the write transistor is connected to a data line, (B-2) the gate electrode of the write transistor is connected to a scan line, and (C-1) the cathode electrode included in the light emitting part is connected to a second power feed line.

The method includes the steps of executing threshold voltage cancel processing of changing the potential of the second node toward the potential obtained by subtracting the threshold voltage of the drive transistor from the potential of the first node in the state in which the potential of the first node is kept, and executing write processing of applying a video signal from the data line to the first node via the write transistor turned to the on-state by a scan signal from the scan line.

The threshold voltage cancel processing is executed in the state in which a first reference voltage is applied from the second power feed line to the cathode electrode included in the light emitting part, and subsequently the write processing is executed in the state in which a second reference voltage lower than the first reference voltage is applied from the second power feed line to the cathode electrode.

According to a second form of the present invention, there is provided a method for driving a display device including (1) N×M display elements that are arranged in a two-dimensional matrix in such a way that N display elements are arranged along a first direction and M display elements are arranged along a second direction different from the first direction, and each include a current-driven light emitting part and a drive circuit, (2) M scan lines extending along the first direction, (3) N data lines extending along the second direction, (4) M first power feed lines extending along the first direction, and (5) M second power feed lines extending along the first direction.

The drive circuit includes a write transistor, a drive transistor, and a capacitive part.

In the display element on an m-th row (m=1, 2, . . . , and M) and an n-th column (n=1, 2, . . . , and N), (A-1) one source/drain region of the drive transistor is connected to an m-th first power feed line, (A-2) the other source/drain region of the drive transistor is connected to the anode electrode included in the light emitting part and one electrode of the capacitive part, and forms a second node, (A-3) the gate electrode of the drive transistor is connected to the other source/drain region of the write transistor and the other electrode of the capacitive part, and forms a first node, (B-1) one source/drain region of the write transistor is connected to an n-th data line, (B-2) the gate electrode of the write transistor is connected to an m-th scan line, and (C-1) the cathode electrode included in the light emitting part is connected to an m-th second power feed line.

The method includes the steps of executing threshold voltage cancel processing of changing the potential of the second node toward the potential obtained by subtracting the threshold voltage of the drive transistor from the potential of the first node in the state in which the potential of the first node is kept, and executing write processing of applying a video signal from the data line to the first node via the write transistor turned to the on-state by a scan signal from the scan line.

The threshold voltage cancel processing is executed in the state in which a first reference voltage is applied from the second power feed line to the cathode electrode included in the light emitting part, and subsequently the write processing is executed in the state in which a second reference voltage lower than the first reference voltage is applied from the second power feed line to the cathode electrode.

According to a third form of the present invention, there is provided a method for driving a display device including (1) N×M display elements that are arranged in a two-dimensional matrix in such a way that N display elements are arranged along a first direction and M display elements are arranged along a second direction different from the first direction, and each include a current-driven light emitting part and a drive circuit, (2) M scan lines extending along the first direction, (3) N data lines extending along the second direction, (4) M first power feed lines extending along the first direction, and (5) a common second power feed line.

The drive circuit includes a write transistor, a drive transistor, and a capacitive part.

In the display element on an m-th row (m=1, 2, . . . , and M) and an n-th column (n=1, 2, . . . , and N), (A-1) one source/drain region of the drive transistor is connected to an m-th first power feed line, (A-2) the other source/drain region of the drive transistor is connected to the anode electrode included in the light emitting part and one electrode of the capacitive part, and forms a second node, (A-3) the gate electrode of the drive transistor is connected to the other source/drain region of the write transistor and the other electrode of the capacitive part, and forms a first node, (B-1) one source/drain region of the write transistor is connected to an n-th data line, (B-2) the gate electrode of the write transistor is connected to an m-th scan line, and (C-1) the cathode electrode included in the light emitting part is connected to the common second power feed line.

The method includes the steps of executing threshold voltage cancel processing of changing the potential of the second node toward the potential obtained by subtracting the threshold voltage of the drive transistor from the potential of the first node in the state in which the potential of the first node is kept, and executing write processing of applying a video signal from the data line to the first node via the write transistor turned to the on-state by a scan signal from the scan line.

The threshold voltage cancel processing is executed in the state in which a first reference voltage is applied from the second power feed line to the cathode electrode included in the light emitting part, and subsequently the write processing is executed in the state in which a second reference voltage lower than the first reference voltage is applied from the second power feed line to the cathode electrode.

In the method for driving a display element according to the first form of the present invention, the method for driving a display device according to the second form of the present invention, and the method for driving a display device according to the third form of the present invention, the threshold voltage cancel processing is executed in the state in which the first reference voltage is applied from the second power feed line to the cathode electrode included in the light emitting part, and thereafter the write processing is executed in the state in which the second reference voltage lower than the first reference voltage is applied from the second power feed line to the cathode electrode. This feature can suppress the potential change of the second node $ND_2$ arising due to the potential change of the first node $ND_1$. Therefore, e.g. a countermeasure of setting the amplitude of the video signal large in advance is unnecessary. Conversely, the value of the video signal necessary for obtaining certain luminance can be set relatively smaller, and thus the power consumption can be suppressed.

DETAILED DESCRIPTION OF THE PREFERRED EMBODIMENTS

Figure 1:
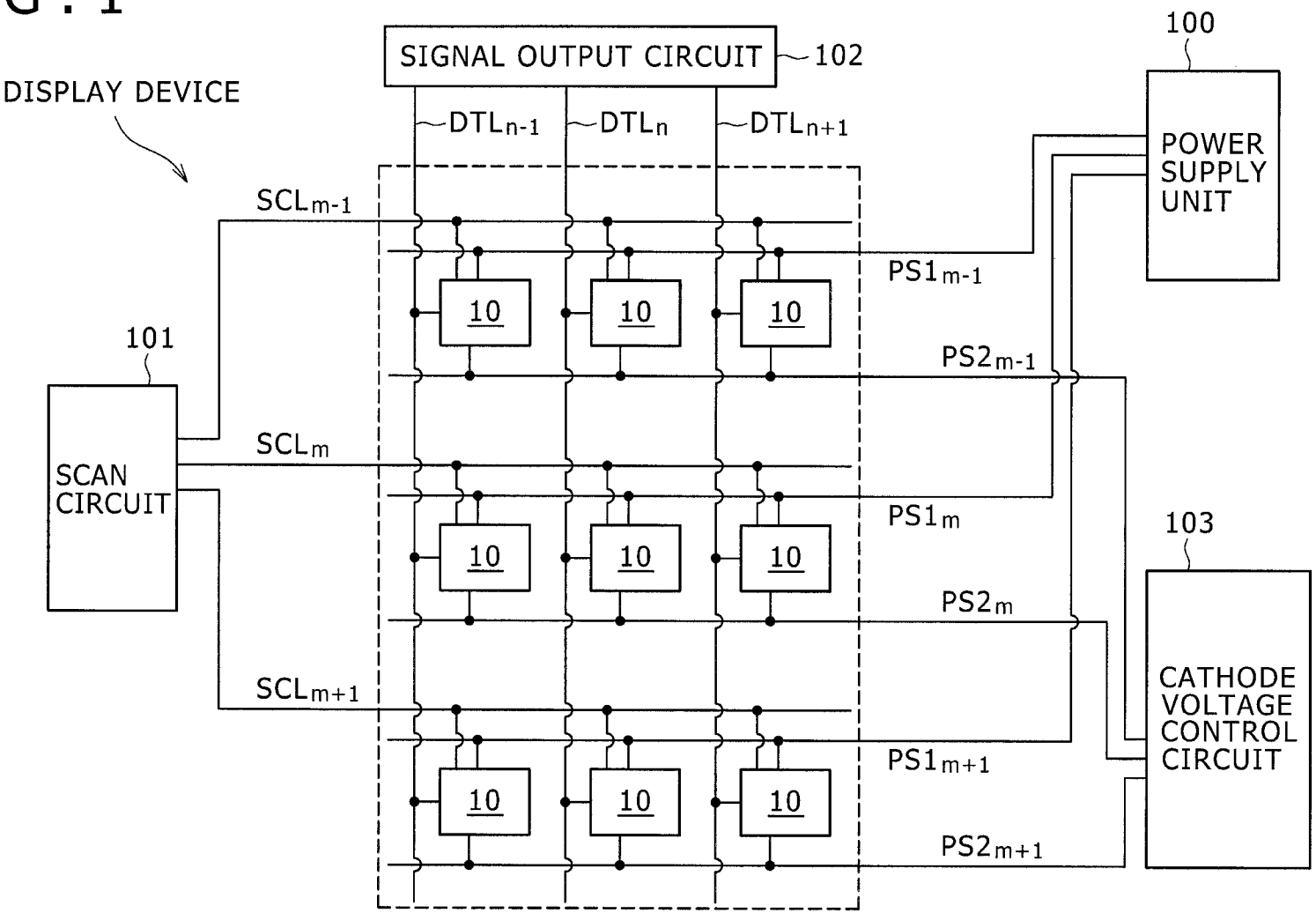
FIG. 1 is a conceptual diagram of a display device according to a first embodiment of the present invention.

Embodiments of the present invention will be described below with reference to the drawings. The description will be made in the following order.

1. More Detailed Description about Method for Driving Display Element and Method for Driving Display Device According to Forms of Present Invention
2. Description of Outline of Display Element and Display Device Used in Respective Embodiments of Present Invention
3. First Embodiment (Form of 2Tr/1C Drive Circuit)
4. Second Embodiment (Form of 2Tr/1C Drive Circuit)

<More Detailed Description about Method for Driving Display Element and Method for Driving Display Device According to Forms of Present Invention>

In the method for driving a display element according to the first form of the present invention, the method for driving a display device according to the second form of the present invention, the method for driving a display device according to the third form of the present invention (hereinafter, these methods will be often collectively referred to simply as the present invention), the value of the first reference voltage and the value of the second reference voltage can be decided depending on the design of the display element and the display device basically. In view of the design of the display device, it is preferable that the first reference voltage and the second reference voltage be a fixed voltage common to the respective display elements. In this case, a configuration in which the following formula holds can be employed.

$$V_{Cat\text{-}H}-V_{Cat\text{-}L}=(V_{Sig_Max}+V_{Sig_Min})/2-V_{Ofs})\cdot c_A/c_B$$

In this formula, $V_{Cat\text{-}H}$ denotes the first reference voltage, $V_{Cat\text{-}L}$ denotes the second reference voltage, $V_{Sig_Max}$ denotes the maximum value that is possibly taken by the video signal, $V_{Sig_Min}$ denotes the minimum value that is possibly taken by the video signal, $c_A$ denotes the capacitance between the first node and the second node, $c_B$ denotes the capacitance between the second node and the second power feed line, and $V_{Ofs}$ denotes the voltage applied to the first node in order to keep the potential of the first node in the threshold voltage cancel processing.

If the capacitance $c_A$ and the capacitance $c_B$ vary depending on the operation of the display element and the display device, the capacitance $c_A$ and the capacitance $c_B$, at the timing of the end of the threshold voltage cancel processing may be used.

In the present invention including the above-described preferred configuration, the following configuration can be employed.

Specifically, pre-processing of initializing the potential of the first node and the potential of the second node is executed so that the potential difference between the first node and the second node may surpass the threshold voltage of the drive transistor and the potential difference between the second node and the cathode electrode included in the light emitting part may not surpass the threshold voltage of the light emitting part.

Subsequently, the threshold voltage cancel processing is executed.

Thereafter the write processing is executed.

Subsequently, the first node is turned to the floating state by switching the write transistor to the off-state by the scan signal from the scan line, and the light emitting part is driven by making the current dependent on the potential difference between the first node and the second node flow through the light emitting part via the drive transistor in the state in which a predetermined drive voltage is applied from the first power feed line to one source/drain region of the drive transistor.

In the present invention including the above-described various kinds of configurations, a current-driven light emitting part that emits light in response to current flow therethrough can be widely used as the light emitting part serving as the light emitting element. Examples of the light emitting part include an organic electroluminescence light emitting part, an inorganic electroluminescence light emitting part, an LED light emitting part, and a semiconductor laser light emitting part. These light emitting parts can be formed by using known materials and methods. In view of forming a color-displaying flat panel display device, a configuration in which the light emitting part is formed of the organic electroluminescence light emitting part among these light emitting parts is preferable. The organic electroluminescence light emitting part may be either the so-called top-emission type or bottom-emission type.

The conditions represented by the various kinds of formulas in the present specification are satisfied when the formulas hold mathematically exactly and also when the formulas substantially hold. In other words, regarding the holding of the formulas, the existence of various variations arising because of the design and manufacturing of the display element and the display device is permitted.

In the present invention, if the potential of the second node reaches the potential obtained by subtracting the threshold voltage of the drive transistor from the potential of the first node by the threshold voltage cancel processing, the drive transistor enters the off-state. On the other hand, if the potential of the second node does not reach the potential obtained by subtracting the threshold voltage of the drive transistor from the potential of the first node, the potential difference between the first node and the second node is higher than the threshold voltage of the drive transistor, and the drive transistor does not enter the off-state. In the driving methods of the present invention, the drive transistor does not necessarily need to enter the off-state as a result of the threshold voltage cancel processing.

The write processing may be executed immediately after the end of the threshold voltage cancel processing, or may be executed with an interval. Furthermore, the write processing may be executed in the state in which a predetermined drive voltage is applied to one source/drain region of the drive transistor. Alternatively, it may be executed in the state in which a predetermined drive voltage is not applied to one source/drain region of the drive transistor. In the former configuration, in conjunction with the write processing, the mobility correction processing of changing the potential of the other source/drain region of the drive transistor depending on a characteristic of the drive transistor is also executed.

The display device may have either a configuration for so-called monochrome displaying or a configuration for color displaying. For example, it is possible to employ a color-displaying configuration in which one pixel is composed of plural sub-pixels, specifically one pixel is composed of three sub-pixels of a red light emitting sub-pixel, a green light emitting sub-pixel, and a blue light emitting sub-pixel. Furthermore, it is also possible that one pixel is composed of a sub-pixel group obtained by adding further one kind or plural kinds of sub-pixels to these three kinds of sub-pixels (e.g. a sub-pixel group obtained by adding a sub-pixel that emits white light for luminance enhancement, a sub-pixel group obtained by adding a sub-pixel that emits light of a complementary color for widening of the color reproduction range, a sub-pixel group obtained by adding a sub-pixel that emits yellow light for widening of the color reproduction range, or a sub-pixel group obtained by adding sub-pixels that emit yellow light and cyan light for widening of the color reproduction range).

As the values of the pixels in the display device, the following several image display resolutions can be cited as examples: VGA (640, 480), S-VGA (800, 600), XGA (1024, 768), APRC (1152, 900), S-XGA (1280, 1024), U-XGA (1600, 1200), HD-TV (1920, 1080), Q-XGA (2048, 1536), (1920, 1035), (720, 480), and (1280, 960). However, the values of the pixels in the display device are not limited to these values.

In the display element and the display device, known configurations and structures can be employed as the configurations and structures of various kinds of interconnects such as the scan line, the data line, the first power feed line, and the second power feed line, and the light emitting part. For example, if the light emitting part is formed of an organic electroluminescence light emitting part, it can be composed of an anode electrode, a hole transport layer, a light emitting layer, an electron transport layer, a cathode electrode, and so on. Various kinds of circuits such as a power supply unit, a scan circuit, a signal output circuit, and a cathode voltage control circuit, which will be described later, can be formed by using a known circuit element and so on.

As the transistor included in the drive circuit, an n-channel thin film transistor (TFT) can be cited. The transistor included in the drive circuit may be either the enhancement type or the depletion type. In the re-channel transistor, a lightly doped drain (LDD) structure may be formed. Depending on the case, the LDD structure may be asymmetrically formed. For example, because it is when the display element emits light that a large current flows through the drive transistor, it is also possible to employ a configuration in which the LDD structure is formed only on one source/drain region side that functions as the drain region side at the time of light emission. A p-channel thin film transistor may be used as e.g. the write transistor.

The capacitive part included in the drive circuit can be composed of one electrode, the other electrode, and a dielectric layer (insulating layer) sandwiched by these electrodes. The above-described transistor and capacitive part included in the drive circuit are formed in a certain flat plane (for example, formed on a support body), and the light emitting part is formed above the transistor and the capacitive part included in the drive circuit with the intermediary of an interlayer insulating layer for example. The other source/drain region of the drive transistor is connected to the anode electrode included in the light emitting part via e.g. a contact hole. A configuration in which the transistor is formed over a semiconductor substrate or the like may be employed.

The embodiments of the present invention will be described below with reference to the drawings. Prior to the description, the outline of the display element and the display device used in the respective embodiments will be described.

<Outline of Display Element and Display Device Used in Respective Embodiments of Present Invention>

The display device suitable for use in the respective embodiments is one including plural pixels. One pixel is composed of plural sub-pixels (in the respective embodiments, three sub-pixels of a red light emitting sub-pixel, a green light emitting sub-pixel, and a blue light emitting sub-pixel). The current-driven light emitting part is formed of an organic electroluminescence light emitting part. Each of the sub-pixels is formed of a display element 10 having a structure obtained by stacking a drive circuit 11 and the light emitting part (light emitting part ELP) connected to this drive circuit 11.

Figure 14:
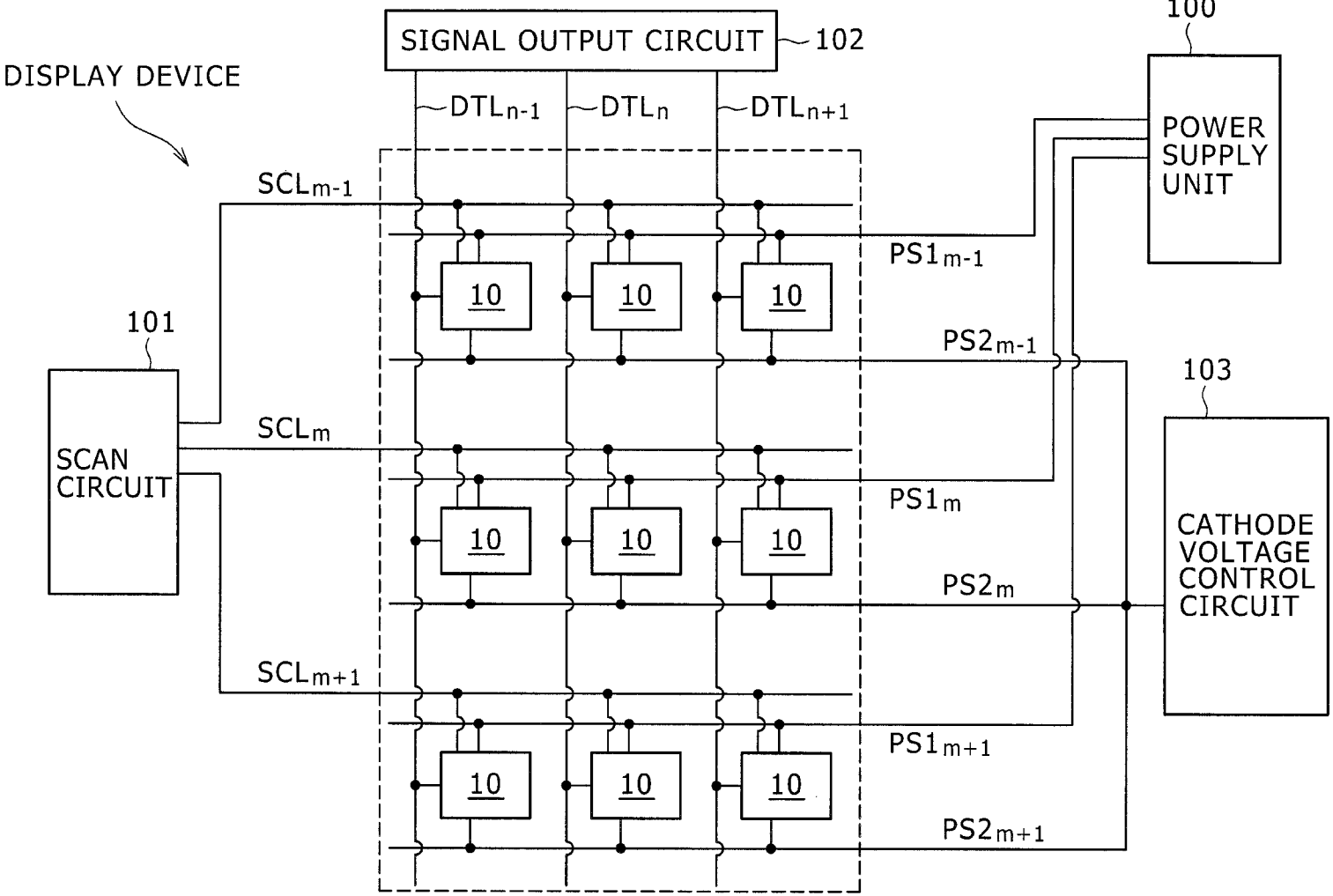
FIG. 14 is a conceptual diagram of a display device according to a second embodiment of the present invention.

A conceptual diagram of a display device used in a first embodiment of the present invention is shown in FIG. 1, and a conceptual diagram of a display device used in a second embodiment of the present invention is shown in FIG. 14.

Figure 2:
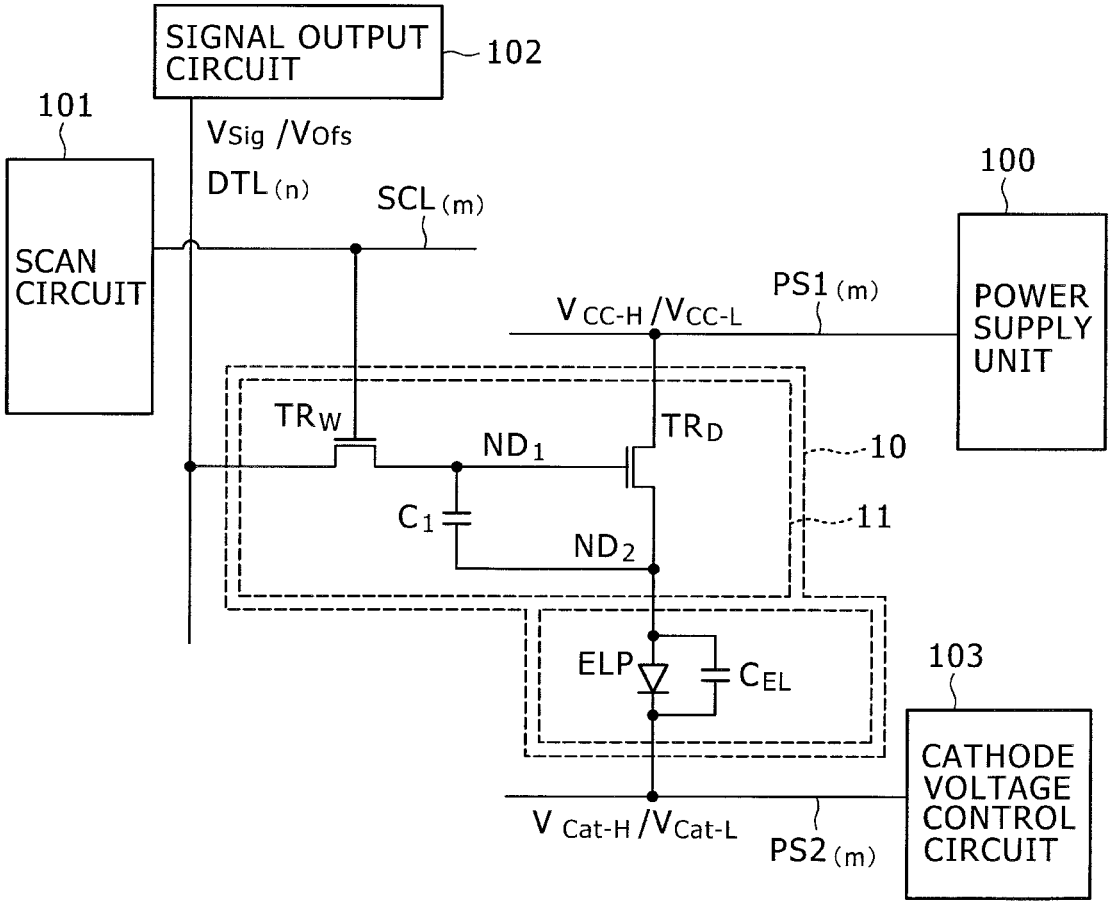
FIG. 2 is an equivalent circuit diagram of a display element including a drive circuit.

In FIG. 2, a drive circuit composed basically of two transistors/one capacitive part (the drive circuit will be often referred to as the 2Tr/1C drive circuit) is shown.

As shown in FIG. 1, the display device used in the first embodiment includes (1) N×M display elements 10 that are arranged in a two-dimensional matrix in such a way that N display elements 10 are arranged along a first direction and M display elements 10 are arranged along a second direction different from the first direction, and each include the current-driven light emitting part ELP and the drive circuit 11, (2) M scan lines SCL extending along the first direction, (3) N data lines DTL extending along the second direction, (4) M first power feed lines PS1 extending along the first direction, and (5) M second power feed lines PS2 extending along the first direction.

The first power feed lines PS1 are connected to a power supply unit 100. The data lines DTL are connected to a signal output circuit 102. The scan lines SCL are connected to a scan circuit 101. The second power feed lines PS2 are connected to a cathode voltage control circuit 103. Although 3×3 display elements 10 are shown in FIG. 1 and FIG. 14, this is merely an example.

As shown in FIG. 14, the display device used in the second embodiment has the same configuration as that of the display device used in the first embodiment, except for that the second power feed line PS2 is a common power feed line. The common second power feed line PS2 is connected to the cathode voltage control circuit 103. In FIG. 14, the illustration is so made that M second power feed lines PS2 are connected to each other to form the common second power feed line PS2, for convenience. However, the configuration is not limited thereto. For example, the common second power feed line may be formed of an electrode formed into a plane shape.

The light emitting part ELP has known configuration and structure including e.g. an anode electrode, a hole transport layer, a light emitting layer, an electron transport layer, and a cathode electrode. Known configurations and structures can be employed as those of the scan circuit 101, the signal output circuit 102, the scan line SCL, the data line DTL, and the power supply unit 100.

The minimum constituent elements of the drive circuit 11 will be described below. The drive circuit 11 includes at least a drive transistor $TR_D$, a write transistor $TR_W$, and a capacitive part $C_1$. The drive transistor $TR_D$ is formed of an n-channel TFT including source/drain regions, a channel forming region, and a gate electrode. The write transistor $TR_W$ is also formed of an n-channel TFT including source/drain regions, a channel forming region, and a gate electrode. The write transistor $TR_W$ may be formed of a p-channel TFT. The drive circuit 11 may further include another transistor.

For the drive transistor $TR_D$, (A-1) one source/drain region of the drive transistor $TR_D$ is connected to the first power feed line PS1, (A-2) the other source/drain region of the drive transistor $TR_D$ is connected to the anode electrode included in the light emitting part ELP and one electrode of the capacitive part $C_1$, and forms a second node $ND_2$, and (A-3) the gate electrode of the drive transistor $TR_D$ is connected to the other source/drain region of the write transistor $TR_W$ and the other electrode of the capacitive part $C_1$, and forms a first node $ND_1$.

More specifically, in the display devices shown in FIG. 1 and FIG. 14, in the display element 10 on the m-th row (m=1, 2, . . . , M) and the n-th column (n=1, 2, . . . , N), one source/drain region of the drive transistor $TR_D$ is connected to the m-th first power feed line $PS1_m$.

For the write transistor $TR_W$, (B-1) one source/drain region of the write transistor $TR_W$ is connected to the data line DTL, and (B-2) the gate electrode of the write transistor $TR_W$ is connected to the scan line SCL.

More specifically, in the display devices shown in FIG. 1 and FIG. 14, in the display element 10 on the m-th row and the n-th column, one source/drain region of the write transistor $TR_W$ is connected to the n-th data line $DTL_n$. The gate electrode of the write transistor $TR_W$ is connected to the m-th scan line $SCL_m$.

For the light emitting part ELP, (C-1) the cathode electrode included in the light emitting part ELP is connected to the second power feed line PS2.

More specifically, in the display device shown in FIG. 1, in the display element 10 on the m-th row and the n-th column, the cathode electrode included in the light emitting part ELP is connected to the m-th second power feed line $PS2_m$. Furthermore, in the display device shown in FIG. 14, in the display element 10 on the m-th row and the n-th column, the cathode electrode included in the light emitting part ELP is connected to the common second power feed line PS2. For convenience, the common second power feed line PS2 connected to the display element 10 on the m-th row and the n-th column shown in FIG. 14 will be often represented as the common second power feed line $PS2_m$ hereinafter.

Figure 3:
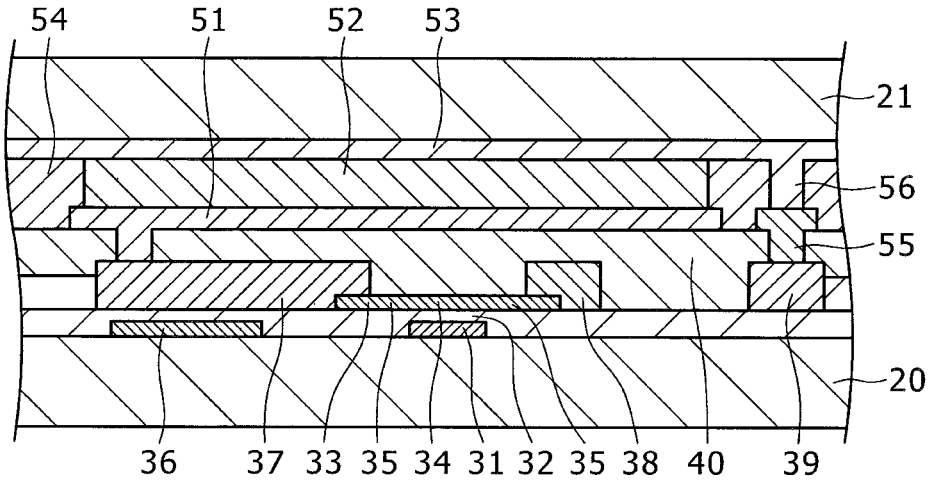
FIG. 3 is a schematic partial sectional view of one part of the display device.

FIG. 3 is a schematic partial sectional view of one part of the display device. The transistors $TR_D$ and $TR_W$ and the capacitive part $C_1$ included in the drive circuit 11 are formed over a support body 20, and the light emitting part ELP is formed above the transistors $TR_D$ and $TR_W$ and the capacitive part $C_1$ included in the drive circuit 11 with the intermediary of an interlayer insulating layer 40 for example. The other source/drain region of the drive transistor $TR_D$ is connected to the anode electrode included in the light emitting part ELP via a contact hole. Only the drive transistor $TR_D$ is illustrated in FIG. 3. The other transistor is hidden and invisible.

More specifically, the drive transistor $TR_D$ is composed of a gate electrode 31, a gate insulating layer 32, source/drain regions 35 provided in a semiconductor layer 33, and a channel forming region 34 corresponding to part of the semiconductor layer 33 between the source/drain regions 35. On the other hand, the capacitive part $C_1$ is composed of the other electrode 36, a dielectric layer formed of an extension part of the gate insulating layer 32, and one electrode 37 (equivalent to the second node $ND_2$). The gate electrode 31, part of the gate insulating layer 32, and the other electrode 36 of the capacitive part $C_1$ are formed on the support body 20. One source/drain region 35 of the drive transistor $TR_D$ is connected to an interconnect 38, and the other source/drain region 35 is connected to one electrode 37. The drive transistor $TR_D$, the capacitive part $C_1$, and so on are covered by the interlayer insulating layer 40. On the interlayer insulating layer 40, the light emitting part ELP composed of an anode electrode 51, a hole transport layer, a light emitting layer, an electron transport layer, and a cathode electrode 53 is provided. In the drawing, the hole transport layer, the light emitting layer, and the electron transport layer are represented by one layer 52. A second interlayer insulating layer 54 is provided on the part of the interlayer insulating layer 40 on which the light emitting part ELP is not provided. A transparent substrate 21 is disposed over the second interlayer insulating layer 54 and the cathode electrode 53, and light emitted by the light emitting layer passes through the substrate 21 and is output to the external. One electrode 37 (second node NEW and the anode electrode 51 are connected to each other via a contact hole provided in the interlayer insulating layer 40. The cathode electrode 53 is connected to an interconnect 39 provided on an extension part of the gate insulating layer 32 via contact holes 56 and 55 provided in the second interlayer insulating layer 54 and the interlayer insulating layer 40.

A method for manufacturing the display device shown in FIG. 3 and so on will be described below. First, over the support body 20, various kinds of interconnects such as the scan line SCL, the electrodes of the capacitive part $C_1$, the transistors including the semiconductor layer, the interlayer insulating layers, the contact holes, and so on are accordingly formed by known methods. Subsequently, film deposition and patterning are carried out by known methods to thereby form the light emitting parts ELP arranged in a matrix. Furthermore, the support body 20 resulting from the above-described steps and the substrate 21 are made to face each other and the periphery is sealed, and thereafter wire connection to the external circuit is carried out, so that the display device can be obtained.

The display devices in the respective embodiments are color-displaying display devices including plural display elements 10 (for example, N×M=1920×480). Each of the display elements 10 serves as a sub-pixel. In addition, one pixel is formed of a group composed of plural sub-pixels, and the pixels are arranged in a two-dimensional matrix along a first direction and a second direction different from the first direction. One pixel is composed of the following three kinds of sub-pixels arranged along the extension direction of the scan lines SCL: a red light emitting sub-pixel that emits red light, a green light emitting sub-pixel that emits green light, and a blue light emitting sub-pixel that emits blue light.

The display device includes (N/3)×M pixels arranged in a two-dimensional matrix. The display elements 10 forming the respective pixels are line-sequentially scanned, and the display frame rate is defined as FR (times/second). Specifically, the display elements 10 serving as (N/3) pixels (N sub-pixels) arranged on the m-th row are simultaneously driven. In other words, in the respective display elements 10 that form one row, the light-emission/non-light-emission timings thereof are controlled in units of row to which they belong. Processing of writing the video signal for the respective pixels that form one row may be either processing of simultaneously writing the video signal for all of the pixels (hereinafter, it will be often referred to simply as the simultaneous write processing) or processing of sequentially writing the video signal on a pixel-by-pixel basis (hereinafter, it will be often referred to simply as the sequential write processing). The choice of which write processing to employ can be accordingly made depending on the configuration of the display device.

As described above, the display elements 10 on the respective rows from the first row to the M-th row are line-sequentially scanned. For convenience of description, the period assigned for scanning the display elements 10 on each row is represented as the horizontal scanning period. In the respective embodiments to be described later, the following periods exist in each horizontal scanning period: a period during which a first node initialization voltage ($V_{Ofs}$ to be described later) is applied from the signal output circuit 102 to the data line DTL (hereinafter, this period will be referred to as the initialization period) and a subsequent period during which a video signal ($V_{Sig}$ to be described later) is applied from the signal output circuit 102 to the data line DTL (hereinafter, the video signal period).

Here, in principle, the driving and operation relating to the display element 10 located on the m-th row and the n-th column will be described, and this display element 10 will be referred to as the (n, m)-th display element 10 or the (n, m)-th sub-pixel hereinafter. By the time the horizontal scanning period for the respective display elements 10 arranged on the m-th row (the m-th horizontal scanning period) ends, various kinds of processing (threshold voltage cancel processing, write processing, and mobility correction processing, which will be described later) are executed. The write processing and the mobility correction processing are executed within the m-th horizontal scanning period. On the other hand, the threshold voltage cancel processing and pre-processing associated with it can be executed earlier than the m-th horizontal scanning period.

After all of the above-described various kinds of processing are ended, the light emitting parts ELP included in the respective display elements 10 arranged on the m-th row are made to emit light. The light emitting parts ELP may be made to emit light immediately after all of the above-described various kinds of processing are ended. Alternatively, the light emitting parts ELP may be made to emit light after the elapse of a predetermined period (e.g. the horizontal scanning periods corresponding to a predetermined number of rows). This predetermined period can be accordingly set depending on the specifications of the display device, the configuration of the drive circuit, and so on. The following description is based on the assumption that the light emitting parts ELP are made to emit light immediately after the various kinds of processing are ended, for convenience of description. The light-emission state of the light emitting parts ELP included in the respective display elements 10 arranged on the m-th row is continued until immediately before the start of the horizontal scanning period for the respective display elements 10 arranged on the (m+m')-th row. This "m'" is decided depending on the design specifications of the display device. That is, the light emission of the light emitting parts ELP included in the respective display elements 10 arranged on the m-th row in a certain display frame is continued until the end of the (m+m'-1)-th horizontal scanning period. On the other hand, from the start timing of the (m+m')-th horizontal scanning period until the completion of the write processing and the mobility correction processing within the m-th horizontal scanning period in the next display frame, the light emitting parts ELP included in the respective display elements 10 arranged on the m-th row keep the non-light-emission state in principle. By setting the period of the non-light-emission state (hereinafter, this period will be often referred to simply as the non-light-emission period), image lag blur accompanying the active-matrix driving is reduced and more excellent moving image quality can be obtained. However, the light-emission state/non-light-emission state of the respective sub-pixels (the display elements 10) is not limited to the above-described states. The time length of the horizontal scanning period is shorter than (1/FR)×(1/M) seconds. If the value of (m+m') surpasses M, the excess part of the horizontal scanning period is processed in the next display frame.

For two source/drain regions of one transistor, the term "one source/drain region" will be often used to refer to the source/drain region connected to the power supply side. Furthermore, the expression "transistor is in the on-state" refers to the state in which the channel is formed between the source/drain regions irrespective of whether or not a current flows from one source/drain region of this transistor to the other source/drain region thereof. On the other hand, the expression "transistor is in the off-state" refers to the state in which the channel is not formed between the source/drain regions. In addition, the expression "a source/drain region of a certain transistor is connected to a source/drain region of another transistor" encompasses a form in which the source/drain region of the certain transistor and the source/drain region of another transistor occupy the same region. Moreover, the source/drain region can be formed not only from an electrically-conductive substance such as poly-silicon or amorphous silicon containing an impurity but also from a layer composed of a metal, an alloy, an electrically-conductive particle, a multilayer structure of these materials, or an organic material (electrically-conductive polymer). Furthermore, in the timing charts used in the following description, the lengths of the abscissa (time lengths) indicating the respective periods are schematic lengths and do not indicate the ratio of the time lengths of the respective periods. The same applies also to the ordinate. In addition, the shapes of waveforms in the timing charts are also schematic shapes.

The embodiments of the present invention will be described below.

First Embodiment

The first embodiment relates to the method for driving a display element according to the first form of the present invention and the method for driving a display device according to the second form of the present invention.

As shown in FIG. 2, the drive circuit 11 in the display element 10 includes two transistors, the write transistor $TR_W$ and the drive transistor $TR_D$, and further includes one capacitive part $C_1$ (2Tr/1C drive circuit). The configuration of the (n, m)-th display element 10 will be described below.

[Drive Transistor $TR_D$]

One source/drain region of the drive transistor $TR_D$ is connected to the m-th first power feed line $PS1_m$. A predetermined voltage is applied from the m-th first power feed line $PS1_m$ to one source/drain region of the drive transistor $TR_D$ based on the operation of the power supply unit 100. Specifically, a drive voltage $V_{CC-H}$ and a voltage $V_{CC-L}$ to be described later are supplied from the power supply unit 100. On the other hand, the other source/drain region of the drive transistor $TR_D$ is connected to

[1] the anode electrode of the light emitting part ELP, and

[2] one electrode of the capacitive part $C_1$, and forms the second node $ND_2$. Furthermore, the gate electrode of the drive transistor $TR_D$ is connected to

[1] the other source/drain region of the write transistor $TR_W$, and

[2] the other electrode of the capacitive part $C_1$, and forms the first node $ND_1$.

The voltage setting of the drive transistor $TR_D$ is so made that the drive transistor $TR_D$ operates in the saturation region in the light-emission state of the display element 10, and the drive transistor $TR_D$ is so driven that the drain current $I_{ds}$ flows therethrough in accordance with the following Formula (1). In the light-emission state of the display element 10, one source/drain region of the drive transistor $TR_D$ serves as the drain region, and the other source/drain region thereof serves as the source region. In the following description, one source/drain region of the drive transistor $TR_D$ will be often referred to simply as the drain region, and the other source/drain region thereof will be often referred to simply as the source region, for convenience of description. The respective parameters are defined as follows.

μ: effective mobility

L: channel length

W: channel width $V_{gs}$: potential difference between gate electrode and source region $V_{th}$: threshold voltage $C_{OX}$: (relative dielectric constant of gate insulating layer)× (permittivity of vacuum)/(thickness of gate insulating layer)

$$k \equiv (1/2)\cdot(W/L)\cdot C_{OX}$$

$$I_{ds} = k\cdot\mu\cdot(V_{gs} - V_{th})^2 \quad (1)$$

Due to the flowing of this drain current $I_{ds}$ through the light emitting part ELP in the display element 10, the light emitting part ELP in the display element 10 emits light. Furthermore, the light-emission state (luminance) of the light emitting part ELP in the display element 10 is controlled depending on the magnitude of this drain current $I_{ds}$.

[Write Transistor $TR_W$]

The other source/drain region of the write transistor $TR_W$ is connected to the gate electrode of the drive transistor $TR_D$ as described above. On the other hand, one source/drain region of the write transistor $TR_W$ is connected to the n-th data line $DTL_n$. A predetermined voltage is applied from the n-th data line $DTL_n$ to one source/drain region of the write transistor $TR_W$ based on the operation of the signal output circuit 102. Specifically, the video signal (drive signal, luminance signal) $V_{Sig}$ for controlling the luminance of the light emitting part ELP and the first node initialization voltage $V_{Ofs}$ to be described later are supplied from the signal output circuit 102. The on/off operation of the write transistor $TR_W$ is controlled by a scan signal from the m-th scan line $SCL_m$ connected to the gate electrode of the write transistor $TR_W$, specifically a scan signal from the scan circuit 101.

[Light Emitting Part ELP]

The anode electrode of the light emitting part ELP is connected to the source region of the drive transistor $TR_D$ as described above. On the other hand, the cathode electrode of the light emitting part ELP is connected to the m-th second power feed line $PS2_m$. A predetermined voltage is applied from the m-th second power feed line $PS2_m$ to the cathode electrode of the light emitting part ELP based on the operation of the cathode voltage control circuit 103. Specifically, a first reference voltage $V_{Cat-H}$ and a second reference voltage $V_{Cat-L}$ to be described later are supplied from the cathode voltage control circuit 103. The capacitance of the light emitting part ELP is represented by sign $C_{EL}$. The threshold voltage necessary for the light emission of the light emitting part ELP is defined as $V_{th-EL}$. That is, the light emitting part ELP emits light if a voltage equal to or higher than $V_{th-EL}$ is applied between the anode electrode and cathode electrode of the light emitting part ELP.

The display device and the driving method thereof according to the first embodiment will be described below.

In the following description, the values of voltages and potentials are defined as follows. However, these values are merely ones for the description, and the values of voltages and potentials are not limited thereto.

$V_{Sig}$: video signal for controlling the luminance of the light emitting part ELP 1 volt (black displaying) to 7 volts (white displaying)

$V_{CC-H}$: drive voltage for current flow through the light emitting part ELP 20 volts $V_{CC-L}$: second node initialization voltage −10 volts $V_{Ofs}$: first node initialization voltage for initializing the potential of the gate electrode of the drive transistor $TR_D$ (the potential of the first node ND')

0 volt $V_{th}$: threshold voltage of the drive transistor $TR_D$ 3 volts $V_{Cat-H}$: first reference voltage 0 volt $V_{Cat-L}$: second reference voltage −1 volt $V_{th-EL}$: threshold voltage of the light emitting part ELP 3 volts The driving methods of the display element and the display device according to the respective embodiments (hereinafter, abbreviated simply as the driving methods) include the steps of (a) executing pre-processing of initializing the potential of the first node $ND_1$ and the potential of the second node $ND_2$ so that the potential difference between the first node $ND_1$ and the second node $ND_2$ can surpass the threshold voltage $V_{th}$ of the drive transistor $TR_D$ and the potential difference between the second node $ND_2$ and the cathode electrode included in the light emitting part ELP can not surpass the threshold voltage $V_{th-EL}$ of the light emitting part ELP, (b) subsequently, executing the threshold voltage cancel processing, (c) thereafter, executing the write processing, and (d) subsequently, turning the first node $ND_1$ to the floating state by switching the write transistor $TR_W$ to the off-state by the scan signal from the scan line SCL, and driving the light emitting part ELP by making the current dependent on the potential difference between the first node $ND_1$ and the second node $ND_2$ to flow through the light emitting part ELP via the drive transistor $TR_D$ in the state in which the predetermined drive voltage $V_{CC-H}$ is applied from the first power feed line $PS1_m$ to one source/drain region of the drive transistor $TR_D$.

In the driving methods of the respective embodiments, the threshold voltage cancel processing is executed in the state in which the first reference voltage $V_{Cat-H}$ is applied from the second power feed line $PS2_m$ to the cathode electrode included in the light emitting part ELP. Thereafter, the write processing is executed in the state in which the second reference voltage $V_{Cat-L}$ lower than the first reference voltage $V_{Cat-H}$ is applied from the second power feed line $PS2_m$ to the cathode electrode. As described later, the threshold voltage cancel processing is executed plural times over plural scanning periods in the respective embodiments. In this case, it is sufficient that at least the threshold voltage cancel processing immediately before the write processing is completed in the state in which the first reference voltage $V_{Cat-H}$ is applied from the second power feed line $PS2_m$ to the cathode electrode included in the light emitting part ELP.

Figure 4:
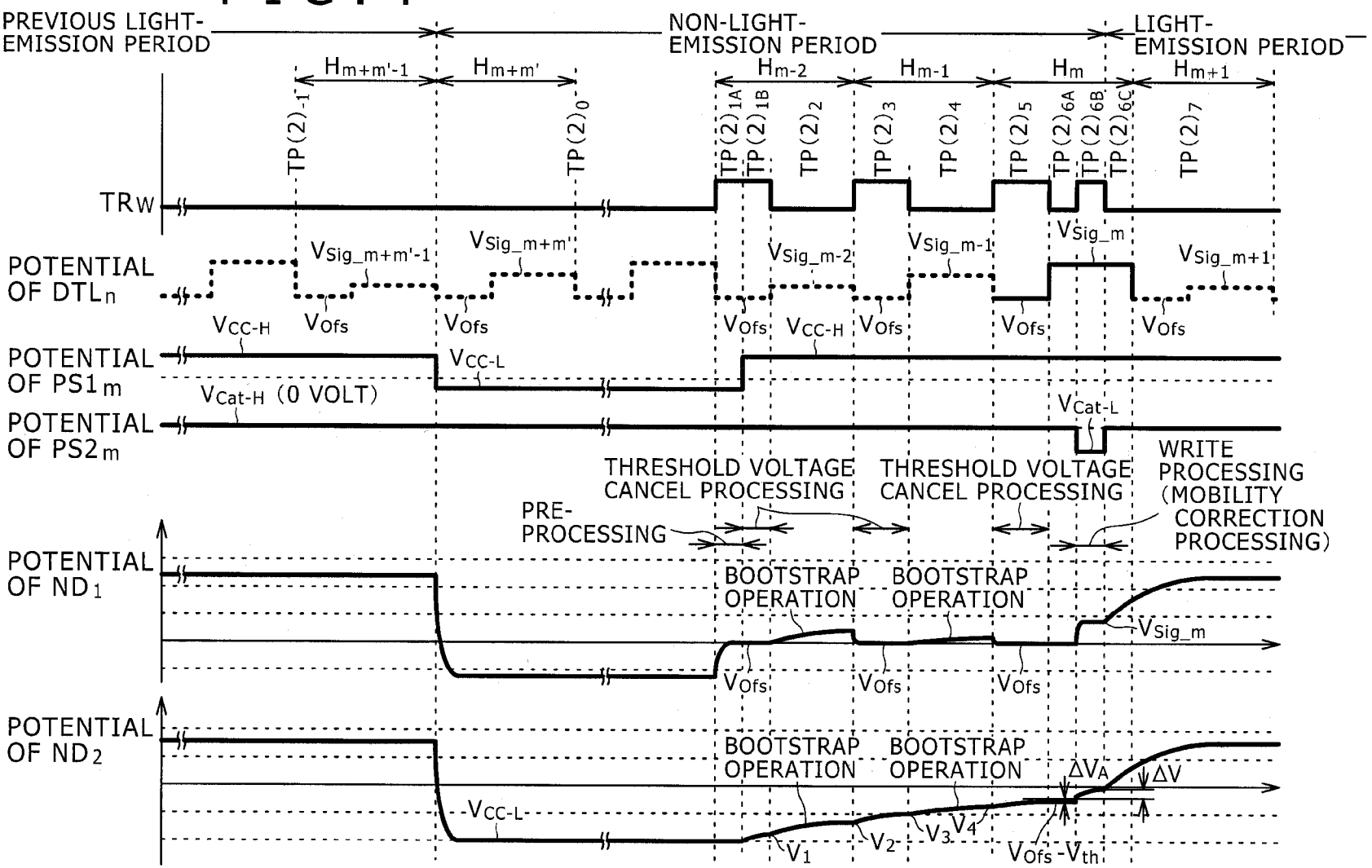
FIG. 4 is a schematic diagram of a timing chart of driving of the display element according to the first embodiment.
Figure 5:
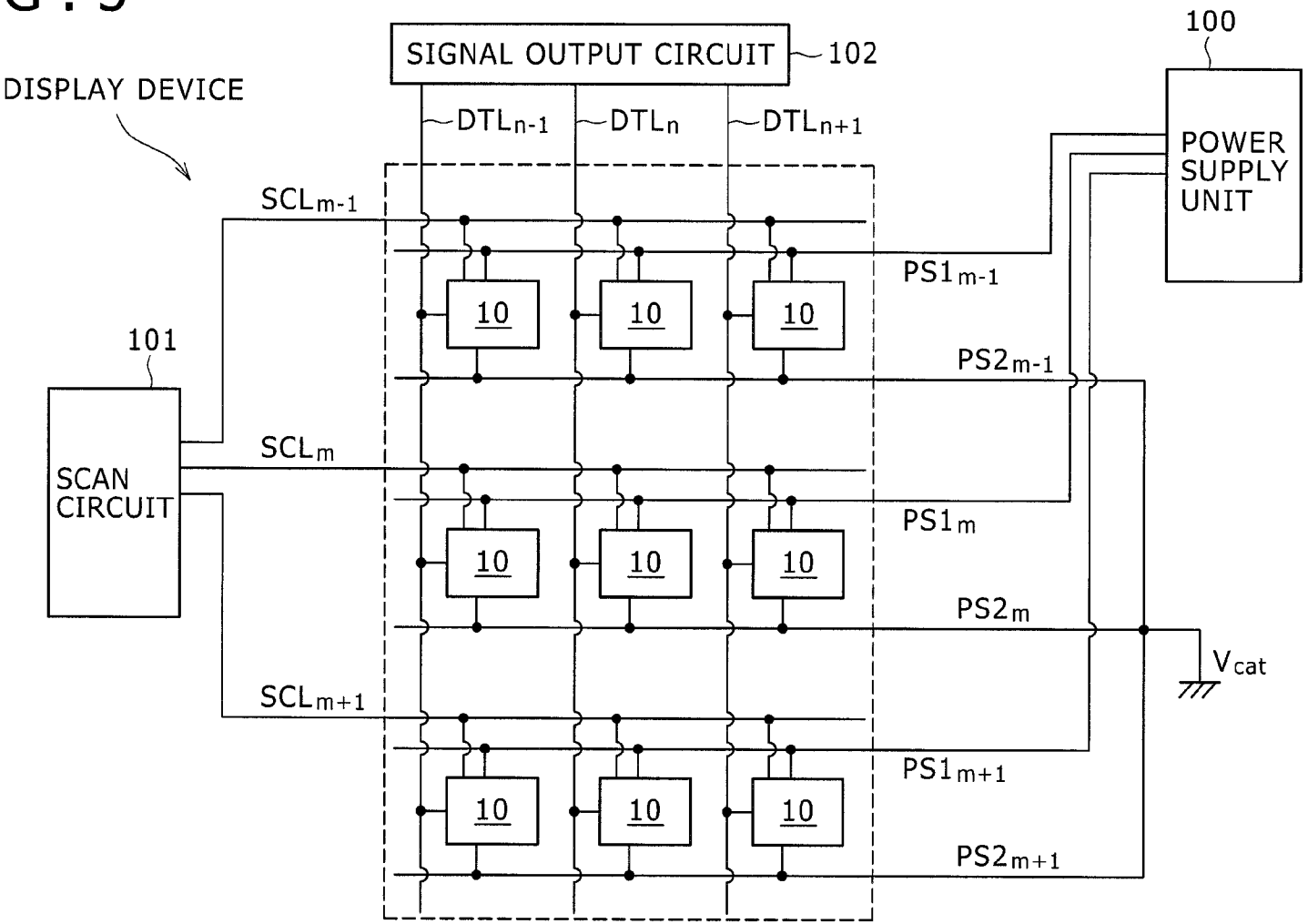
FIG. 5 is a conceptual diagram of a display device according to a reference example.
Figure 6:
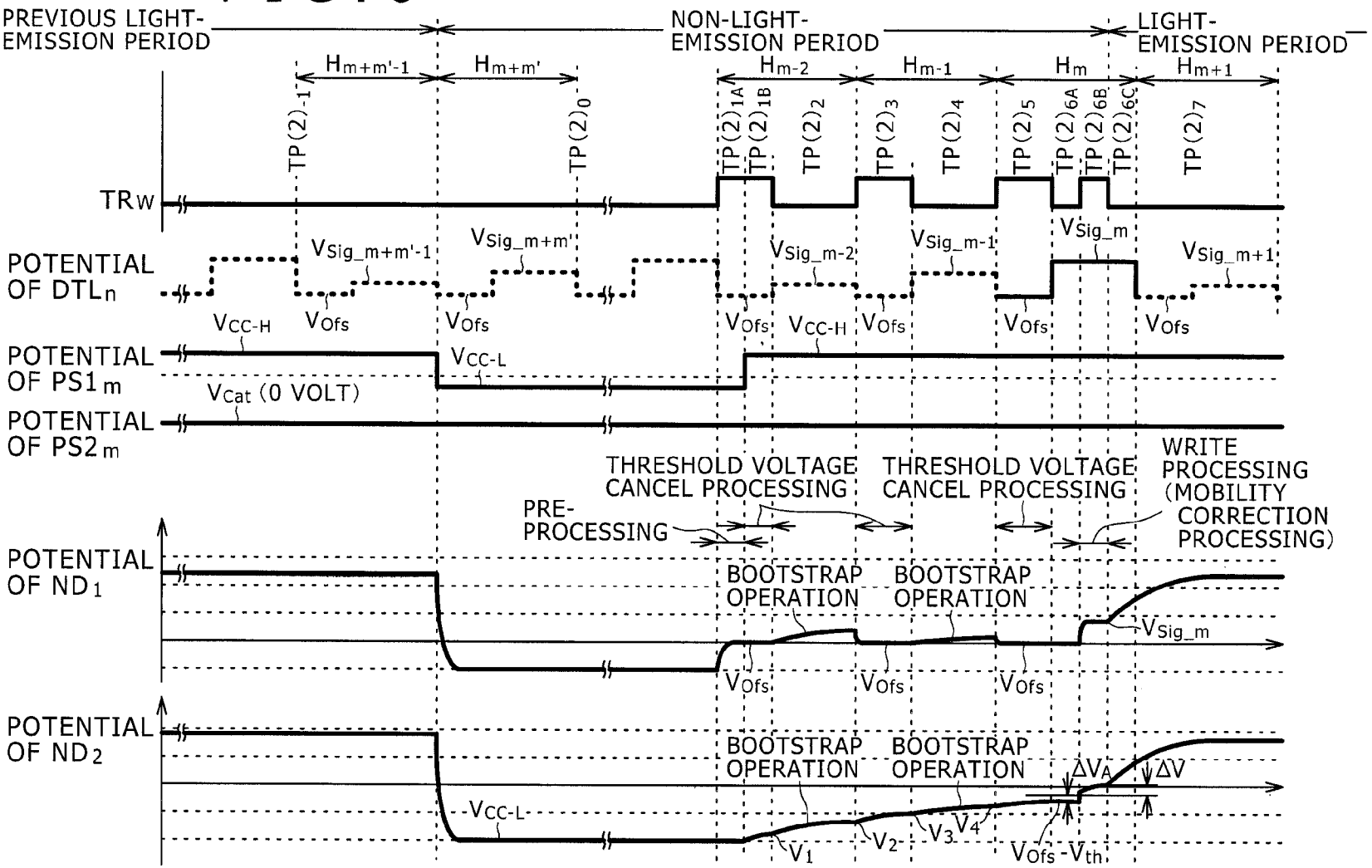
FIG. 6 is a schematic diagram of a timing chart of driving of a display element according to the reference example.

First, to assist understanding of the present invention, a driving method with use of a display device according to a reference example in which a constant voltage is applied to the second power feed line PS2 will be described below as a driving method of the reference example. A timing chart of driving of the display element 10 according to the first embodiment is schematically shown in FIG. 4. A conceptual diagram of the display device according to the reference example is shown in FIG. 5, and a timing chart of driving of the display element 10 according to the reference example is schematically shown in FIG. 6. The on/off-states of the respective transistors and so on in the display element 10 in the operation of the reference example are schematically shown in FIGS. 7A to 7F and FIGS. 8A to 8F.

As shown in FIG. 5, in the display device of the reference example, M second power feed lines PS2 are connected to each other to form a common second power feed line PS2. A constant voltage is applied to the common second power feed line PS2. In the example shown in FIG. 5, the common second power feed line PS2 is grounded and the voltage (potential) thereof is $V_{Cat}$ (=0 volt). Except for this difference, the configuration of the display device of the reference example is the same as that of the display device shown in FIG. 1.

With reference to FIG. 6, FIGS. 7A to 7F, and FIGS. 8A to 8F, the driving method of the reference example will be described below. The driving method in the reference example is different from the embodiments in that both of the threshold voltage cancel processing and the write processing are executed in the state in which the constant voltage $V_{Cat}$ (=0 volt) is applied from the second power feed line PS2 to the cathode electrode included in the light emitting part ELP.

Figure 7A:
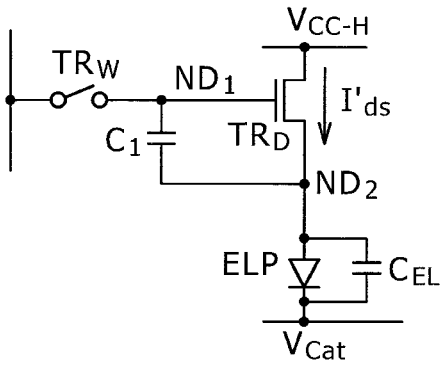
FIGS. 7A to 7F are diagrams schematically showing the on/off-states of the respective transistors and so on in a drive circuit in the display element.

[Period-TP(2)$_{-1}$] (see FIG. 6 and FIG. 7A)

This [period-TP(2)$_{-1}$] is e.g. the period during which the operation in the previous display frame is carried out and the (n, m)-th display element 10 is in the light-emission state after the completion of the previous various kinds of processing. Specifically, a drain current $I'_{ds}$ based on Formula (5') to be described later flows through the light emitting part ELP in the display element 10 serving as the (n, m)-th sub-pixel, and the luminance of the display element 10 serving as the (n, m)-th sub-pixel has the value dependent on this drain current $I'_{ds}$. The write transistor $TR_W$ is in the off-state, and the drive transistor $TR_D$ is in the on-state. The light-emission state of the (n, m)-th display element 10 is continued until immediately before the start of the horizontal scanning period for the display elements 10 arranged on the (m+m')-th row.

Corresponding to the respective horizontal scanning periods, the first node initialization voltage $V_{Ofs}$ and the video signal $V_{Sig}$ are applied to the data line $DTL_n$. However, the write transistor $TR_W$ is in the off-state. Therefore, although the potential (voltage) of the data line $DTL_n$ changes in [period-TP(2)$_{-1}$], the potentials of the first node $ND_1$ and the second node $ND_2$ do not change (in practice, potential changes due to electrostatic coupling of the parasitic capacitance and so on possibly occur, but these changes can be ignored in general). This applies also to [period-TP(2)$_0$] to be described later.

The period from [period-TP(2)$_0$] to [period-TP(2)$_{6A}$] is the operation period from the end of the light-emission state after the completion of the previous various kinds of processing until immediately before the next write processing. In the period from [period-TP(2)$_0$] to [period-TP(2)$_{6B}$], the (n, m)-th display element 10 is in the non-light-emission state in principle. As shown in FIG. 6, [period-TP(2)$_5$], [period-TP(2)$_{6A}$], [period-TP(2)$_{6B}$], and [period-TP(2)$_{6C}$] are included in the m-th horizontal scanning period $H_m$.

In the reference example and the respective embodiments to be described later, the above-described step (b), i.e. the threshold voltage cancel processing, is carried out over plural scanning periods, more specifically over the scanning periods from the (m−2)-th horizontal scanning period $H_{m-2}$ to the m-th horizontal scanning period $H_m$. However, the configuration is not limited thereto.

For convenience of description, suppose that the start timing of [period-TP(2)$_{1A}$] corresponds with the start timing of the initialization period (in FIG. 6, the period during which the potential of the data line $DTL_n$ is $V_{Ofs}$, and this applies also to the other horizontal scanning periods) in the (m−2)-th horizontal scanning period $H_{m-2}$. Similarly, suppose that the end timing of [period-TP(2)$_{1B}$] corresponds with the end timing of the initialization period in the horizontal scanning period $H_{m-2}$. Furthermore, suppose that the start timing of [period-TP(2)$_2$] corresponds with the start timing of the video signal period (in FIG. 6, the period during which the potential of the data line $DTL_n$ is the video signal $V_{Sig}$, and this applies also to the other horizontal scanning periods) in the horizontal scanning period $H_{m-2}$.

Each of the periods from [period-TP(2)$_0$] to [period-TP(2)$_7$] will be described below. The start timing of [period-TP(2)$_{1B}$] and the length of each of the periods from [period-TP(2)$_{6A}$] to [period-TP(2)$_{6C}$] can be accordingly set depending on the design of the display element and the display device.

Figure 7B:
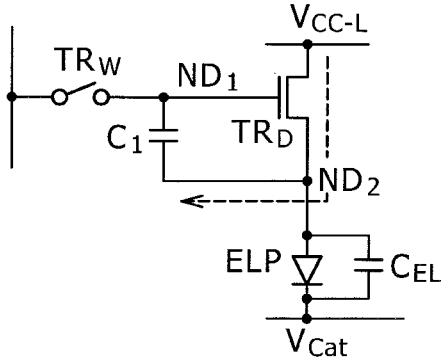

[Period-TP(2)$_0$] (see FIG. 6 and FIG. 7B)

In this [period-TP(2)$_0$], e.g. operation relates to transition from the previous display frame to the present display frame. Specifically, this [period-TP(2)$_0$] is equivalent to the period from the start timing of the (m+m')-th horizontal scanning period $H_{m+m'}$ in the previous display frame to the end timing of the (m−3)-th horizontal scanning period in the present display frame. In this [period-TP(2)$_0$], the (n, m)-th display element 10 is in the non-light-emission state in principle. At the start timing of [period-TP(2)$_0$], the voltage supplied from the power supply unit 100 to the first power feed line PS1$_m$ is switched from the drive voltage $V_{CC-H}$ to the second node initialization voltage $V_{CC-L}$. As a result, the potential of the second node $ND_2$ is lowered to $V_{CC-L}$, and a reverse voltage is applied between the anode electrode and cathode electrode of the light emitting part ELP, so that the light emitting part ELP enters the non-light-emission state. In the wake of the potential lowering of the second node $ND_2$, the potential of the first node ND' in the floating state (the gate electrode of the drive transistor $TR_D$) is also lowered.

Figure 7C:
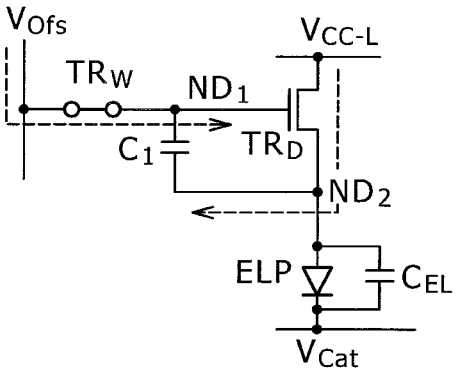

[Period-TP(2)$_{1A}$] (see FIG. 6 and FIG. 7C)

Subsequently, the (m−2)-th horizontal scanning period $H_{m-2}$ in the present display frame starts. In this [period-TP(2)$_{1A}$], the above-described step (a), i.e. the pre-processing, is carried out.

As described above, in each horizontal scanning period, from the signal output circuit 102 to the data line $DTL_n$, the first node initialization voltage $V_{Ofs}$ is applied and subsequently the video signal $V_{Sig}$ is applied instead of the first node initialization voltage $V_{Ofs}$. More specifically, corresponding to the (m−2)-th horizontal scanning period $H_{m-2}$ in the present display frame, the first node initialization voltage $V_{Ofs}$ is applied to the data line $DTL_n$, and subsequently the video signal corresponding to the (n, m−2)-th sub-pixel (for convenience, represented as $V_{Sig_m-2}$, and this applies also to the other video signals) is applied instead of the first node initialization voltage $V_{Ofs}$. This applies also to the other horizontal scanning periods. Although illustration is omitted in FIG. 6, the first node initialization voltage $V_{Ofs}$ and the video signal $V_{Sig}$ are applied to the data line $DTL_n$ also in the respective horizontal scanning periods other than the horizontal scanning periods $H_{m-2}$ $H_{m-1}$, $H_m$, $H_{m+1}$, $H_{m+m'-1}$, and $H_{m+m'}$.

Specifically, at the start of [period-TP(2)$_{1A}$], the write transistor $TR_W$ is turned to the on-state by switching the scan line $SCL_m$ to the high level. The voltage applied from the signal output circuit 102 to the data line $DTL_n$ is $V_{Ofs}$ (initialization period). As a result, the potential of the first node $ND_1$ becomes $V_{Ofs}$ (0 volt). Because the second node initialization voltage $V_{CC-L}$ is applied from the first power feed line PS1$_m$ to the second node $ND_2$ based on the operation of the power supply unit 100, $V_{CC-L}$ (−10 volts) is kept as the potential of the second node $ND_2$.

The potential difference between the first node $ND_1$ and the second node $ND_2$ is 10 volts, and the threshold voltage $V_{th}$ of the drive transistor $TR_D$ is 3 volts. Thus, the drive transistor $TR_D$ is in the on-state. The potential difference between the second node $ND_2$ and the cathode electrode included in the light emitting part ELP is −10 volts, and this potential difference does not surpass the threshold voltage $V_{th-EL}$ of the light emitting part ELP. By this operation, the pre-processing of initializing the potential of the first node $ND_1$ and the potential of the second node $ND_2$ is completed.

For the pre-processing, it is possible to employ a configuration in which the write transistor $TR_W$ is turned to the on-state after the voltage applied to the data line $DTL_n$ is switched to the first node initialization voltage $V_{Ofs}$. Alternatively, it is also possible to employ a configuration in which the write transistor $TR_W$ is turned to the on-state by the signal from the scan line before the start timing of the horizontal scanning period in which the pre-processing is to be executed. In the latter configuration, when the first node initialization voltage $V_{Ofs}$ is applied to the data line $DTL_n$, immediately the potential of the first node $ND_1$ is initialized. In the former configuration, in which the write transistor $TR_W$ is turned to the on-state after the voltage applied to the data line $DTL_n$ is switched to the first node initialization voltage $V_{Ofs}$, time including the time for waiting the switching needs to be allocated to the pre-processing. In contrast, in the latter configuration, the time for waiting the switching is unnecessary and the pre-processing can be executed in a shorter time.

Subsequently, over the period from [period-TP(2)$_{1B}$] to [period-TP(2)$_5$], the above-described step (b), i.e. the threshold voltage cancel processing, is carried out. Specifically, the first threshold voltage cancel processing is executed in [period-TP(2)$_{1B}$]. The second threshold voltage cancel processing is executed in [period-TP(2)$_3$]. The third threshold voltage cancel processing is executed in [period-TP(2)$_5$].

Figure 7D:
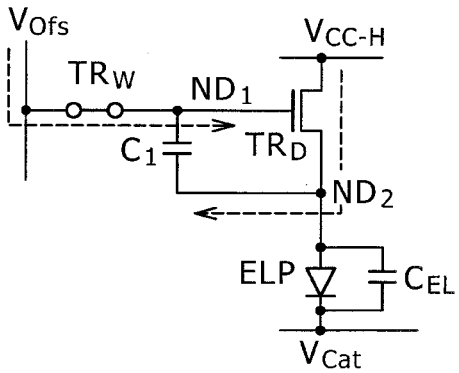

[Period-TP(2)$_{1B}$] (see FIG. 6 and FIG. 7D)

Specifically, the voltage supplied from the power supply unit 100 to the first power feed line PS1$_m$ is switched from the voltage $V_{CC-L}$ to the drive voltage $V_{CC-H}$, with the on-state of the write transistor $TR_W$ kept. As a result, although the potential of the first node $ND_1$ does not change (kept at $V_{Ofs}$=0 volt), the potential of the second node $ND_2$ changes toward the potential obtained by subtracting the threshold voltage $V_{th}$ of the drive transistor $TR_D$ from the potential of the first node $ND_1$. That is, the potential of the second node $ND_2$ rises.

If this [period-TP(2)$_{1B}$] is sufficiently long, the potential difference between the gate electrode of the drive transistor $TR_D$ and the other source/drain region thereof reaches $V_{th}$, and the drive transistor $TR_D$ enters the off-state. Specifically, the potential of the second node $ND_2$ comes close to ($V_{Ofs}-V_{th}$) and finally becomes ($V_{Ofs}-V_{th}$). However, in the example shown in FIG. 6, the length of [period-TP(2)$_{1B}$] is not enough to sufficiently change the potential of the second node $ND_2$. Therefore, at the end timing of [period-TP(2)$_{1B}$], the potential of the second node $ND_2$ reaches a certain potential $V_1$ that satisfies the relationship $V_{CC-L}<V_1<(V_{Ofs}-V_{th})$.

Figure 7E:
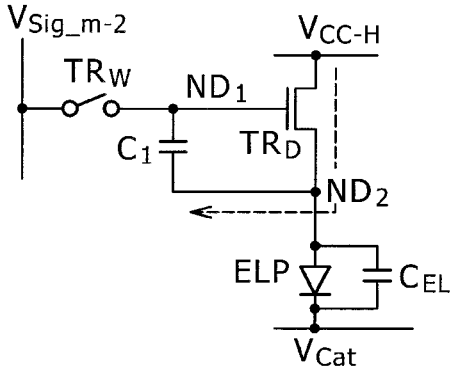

[Period-TP(2)$_2$] (see FIG. 6 and FIG. 7E)

At the start timing of [period-TP(2)$_2$], the voltage of the data line $DTL_n$ is switched from the first node initialization voltage $V_{Ofs}$ to the video signal $V_{Sig_m-2}$. In order to prevent the video signal $V_{Sig_m-2}$ from being applied to the first node $ND_1$, the write transistor $TR_W$ is turned to the off-state by the signal from the scan line $SCL_m$ at the start timing of this [period-TP(2)$_2$]. As a result, the first node $ND_1$ becomes the floating state.

Because the drive voltage $V_{CC-H}$ is applied from the power supply unit 100 to one source/drain region of the drive transistor $TR_D$, the potential of the second node $ND_2$ rises from the potential $V_1$ to a certain potential $V_2$. On the other hand, the gate electrode of the drive transistor $TR_D$ is in the floating state, and the capacitive part $C_1$ exists. Thus, bootstrap operation occurs at the gate electrode of the drive transistor $TR_D$. Consequently, the potential of the first node $ND_1$ rises in the wake of the potential change of the second node $ND_2$.

Figure 7F:
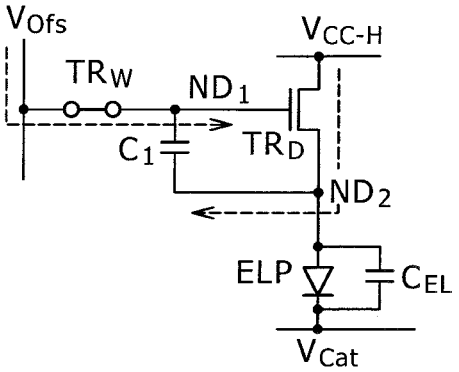

[Period-TP(2)$_3$] (see FIG. 6 and FIG. 7F)

At the start timing of [period-TP(2)$_3$], the voltage of the data line $DTL_n$ is switched from the video signal $V_{Sig_m-2}$ to the first node initialization voltage $V_{Ofs}$. At the start timing of this [period-TP(2)$_3$], the write transistor $TR_W$ is turned to the on-state by the signal from the scan line $SCL_m$. As a result, the potential of the first node $ND_1$ becomes $V_{Ofs}$. The drive voltage $V_{CC-H}$ is applied from the power supply unit 100 to one source/drain region of the drive transistor $TR_D$. As a result, the potential of the second node $ND_2$ changes toward the potential obtained by subtracting the threshold voltage $V_{th}$ of the drive transistor $TR_D$ from the potential of the first node $ND_1$. That is, the potential of the second node $ND_2$ rises from the potential $V_2$ to a certain potential $V_3$.

Figure 8A:
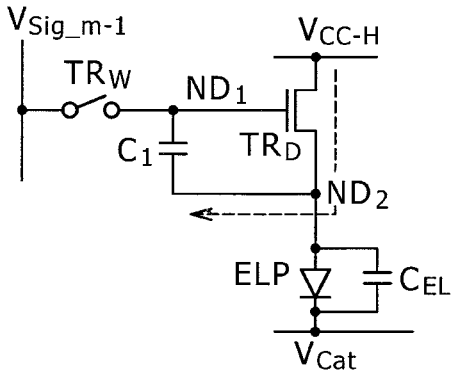
FIGS. 8A to 8F are diagrams schematically showing, subsequently to FIG. 7F, the on/off-states of the respective transistors and so on in the drive circuit in the display element.

[Period-TP(2)$_4$] (see FIG. 6 and FIG. 8A)

At the start timing of [period-TP(2)$_4$], the voltage of the data line $DTL_n$ is switched from the first node initialization voltage $V_{Ofs}$ to the video signal $V_{Sig_m-1}$. In order to prevent the video signal $V_{Sig_m-1}$ from being applied to the first node $ND_1$, the write transistor $TR_W$ is turned to the off-state by the signal from the scan line $SCL_m$ at the start timing of this [period-TP(2)$_4$]. As a result, the first node $ND_1$ becomes the floating state.

Because the drive voltage $V_{CC-H}$ is applied from the power supply unit 100 to one source/drain region of the drive transistor $TR_D$, the potential of the second node $ND_2$ rises from the potential $V_3$ to a certain potential $V_4$. On the other hand, the gate electrode of the drive transistor $TR_D$ is in the floating state, and the capacitive part $C_1$ exists. Thus, bootstrap operation occurs at the gate electrode of the drive transistor $TR_D$. Consequently, the potential of the first node $ND_1$ rises in the wake of the potential change of the second node $ND_2$.

As the premise of the operation in [period-TP(2)$_5$], it is necessary that the potential $V_4$ of the second node $ND_2$ be lower than ($V_{Ofs}-V_{th}$) at the start timing of [period-TP(2)$_5$]. The length from the start timing of [period-TP(2)$_{1B}$] to the start timing of [period-TP(2)$_5$] is so decided that the condition $V_4<(V_{Ofs}-V_{th})$ is satisfied.

Figure 8B:
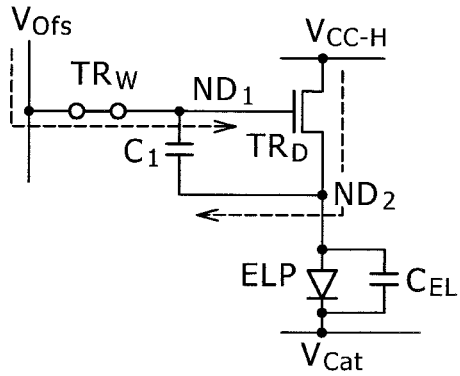

[Period-TP(2)$_5$] (see FIG. 6 and FIG. 8B)

The operation in [period-TP(2)$_5$] is basically the same as the above-described operation in [period-TP(2)$_3$]. At the start timing of this [period-TP(2)$_5$], the voltage of the data line $DTL_n$ is switched from the video signal $V_{Sig_m-1}$ to the first node initialization voltage $V_{Ofs}$. At the start timing of this [period-TP(2)$_5$], the write transistor $TR_W$ is turned to the on-state by the signal from the scan line $SCL_m$.

The first node $ND_1$ becomes the state in which the first node initialization voltage $V_{Ofs}$ is applied thereto from the data line $DTL_n$ via the write transistor $TR_W$. Furthermore, the drive voltage $V_{CC-H}$ is applied from the power supply unit 100 to one source/drain region of the drive transistor $TR_D$. Therefore, similarly to the above-described operation in [period-TP(2)$_3$], the potential of the second node $ND_2$ changes toward the potential obtained by subtracting the threshold voltage $V_{th}$ of the drive transistor $TR_D$ from the potential of the first node $ND_1$. If the potential difference between the gate electrode of the drive transistor $TR_D$ and the other source/drain region thereof reaches $V_{th}$, the drive transistor $TR_D$ becomes the off-state. In this state, the potential of the second node $ND_2$ is substantially ($V_{Ofs}-V_{th}$). At this time, the light emitting part ELP does not emit light if the following Formula (2) is ensured, in other words, if the potentials are so selected and decided as to satisfy Formula (2).

$$(V_{Ofs}-V_{th})<(V_{th\text{-}EL}+V_{Cat}) \quad (2)$$

In this [period-TP(2)$_5$], the potential of the second node $ND_2$ finally becomes ($V_{Ofs}-V_{th}$). That is, the potential of the second node $ND_2$ is decided depending only on the threshold voltage $V_{th}$ of the drive transistor $TR_D$ and the voltage $V_{Ofs}$ for initializing the potential of the gate electrode of the drive transistor $TR_D$. The potential of the second node $ND_2$ has no relation to the threshold voltage $V_{th\text{-}EL}$ of the light emitting part ELP.

Figure 8C:
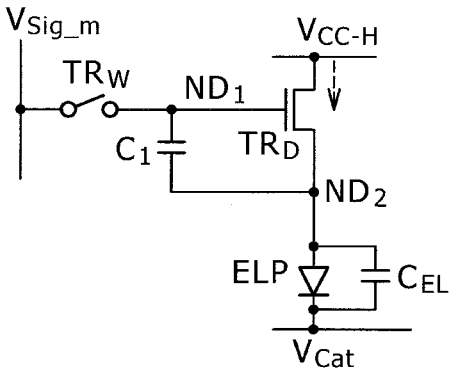

[Period-TP(2)$_{6A}$] (see FIG. 6 and FIG. 8C)

At the start timing of this [period-TP(2)$_{6A}$], the write transistor $TR_W$ is turned to the off-state by the scan signal from the scan line $SCL_m$. Furthermore, the voltage applied to the data line $DTL_n$ is switched from the first node initialization voltage $V_{Ofs}$ to the video signal $V_{Sig_m}$ (video signal period). If the drive transistor $TR_D$ has become the off-state in the threshold voltage cancel processing, substantially the potentials of the first node $ND_1$ and the second node $ND_2$ do not change. If the drive transistor $TR_D$ has not become the off-state in the threshold voltage cancel processing executed in [period-TP(2)$_5$], bootstrap operation occurs in [period-TP(2)$_{6A}$], and the potentials of the first node $ND_1$ and the second node $ND_2$ somewhat rise.

Figure 8D:
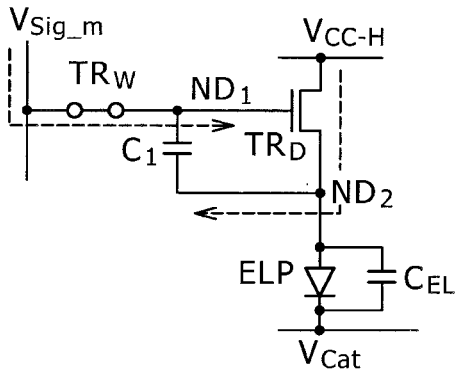

[Period-TP(2)$_{6B}$] (see FIG. 6 and FIG. 8D)

In this period, the above-described step (c), i.e. the write processing, is executed. The write transistor $TR_W$ is turned to the on-state by the scan signal from the scan line $SCL_m$. The video signal $V_{Sig_m}$ is applied from the data line $DTL_n$ to the first node $ND_1$ via the write transistor $TR_W$. As a result, the potential of the first node $ND_1$ rises to $V_{Sig_m}$. The drive transistor $TR_D$ is in the on-state. Depending on the case, it is also possible to employ a configuration in which the on-state of the write transistor $TR_W$ is kept in [period-TP(2)$_{6A}$]. In this configuration, when the voltage of the data line $DTL_n$ is switched from the first node initialization voltage $V_{Ofs}$ to the video signal $V_{Sig_m}$ in [period-TP(2)$_{6A}$], immediately the write processing is started. This applies also to the embodiment to be described later.

Here, the value of the capacitive part $C_1$ is defined as the value $c_1$, and the value of the capacitance $C_{EL}$ of the light emitting part ELP is defined as the value $c_{EL}$. Furthermore, the value of the parasitic capacitance between the gate electrode of the drive transistor $TR_D$ and the other source/drain region thereof is defined as $c_{gs}$. If the capacitance between the first node $ND_1$ and the second node $ND_2$ is represented by sign $c_A$, $c_A=c_1+c_{gs}$ holds. If the capacitance between the second node $ND_2$ and the second power feed line PS2 is represented by sign $c_B$, $c_B=c_{EL}$ holds. An additional capacitive part may be connected in parallel to both ends of the light emitting part ELP. In this case, the capacitance of the additional capacitive part is further added to $c_B$.

When the potential of the gate electrode of the drive transistor $TR_D$ changes from $V_{Ofs}$ to $V_{Sig_m}$ ($>V_{Ofs}$), the voltage between the first node $ND_1$ and the second node $ND_2$ changes. Specifically, the charge based on the change of the potential of the gate electrode of the drive transistor $TR_D$ (=the potential of the first node $ND_1$) ($V_{Sig_m}-V_{Ofs}$) is distributed depending on the capacitance between the first node $ND_1$ and the second node $ND_2$ and the capacitance between the second node $ND_2$ and the second power feed line PS2. However, the potential change of the second node $ND_2$ is small if the value $c_B$, ($=c_{EL}$) is sufficiently larger than the value $c_A$ ($=c_1+c_{gs}$). In general, the value $c_{EL}$ of the capacitance $C_{EL}$ of the light emitting part ELP is larger than the value $c_1$ of the capacitive part $C_1$ and the value $c_{gs}$ of the parasitic capacitance of the drive transistor $TR_D$. For convenience, hereinafter, the description will be made without taking into consideration the potential change of the second node $ND_2$ arising due to the potential change of the first node $ND_1$. In the timing chart of the driving shown in FIG. 6, the potentials are shown without taking into consideration the potential change of the second node $ND_2$ arising due to the potential change of the first node $ND_1$ except for [period-TP(2)$_{6B}$]. This applies also to FIG. 4. In addition, this applies also to FIG. 10, FIG. 13, and FIG. 15, to which reference will be made later.

In the above-described write processing, the video signal $V_{Sig_m}$ is applied to the gate electrode of the drive transistor $TR_D$ in the state in which the drive voltage $V_{CC\text{-}H}$ is applied from the power supply unit 100 to one source/drain region of the drive transistor $TR_D$. Therefore, as shown in FIG. 6, the potential of the second node $ND_2$ rises in [period-TP(2)$_{6B}$]. The amount of rise of the potential ($\Delta V$ shown in FIG. 6) will be described later. If the potential of the gate electrode of the drive transistor $TR_D$ (first node $ND_1$) is defined as $V_g$ and the potential of the other source/drain region of the drive transistor $TR_D$ (second node $ND_2$) is defined as $V_s$, the value of $V_g$ and the value of $V_s$ are as follows unless the above-described potential rise of the second node $ND_2$ is not taken into consideration. The potential difference between the first node $ND_1$ and the second node $ND_2$, i.e. the potential difference $V_{gs}$ between the gate electrode of the drive transistor $TR_D$ and the other source/drain region thereof serving as the source region, can be represented by the following Formula (3).

$$V_g=V_{Sig_m}$$

$$V_s\approx V_{Ofs}-V_{th}$$

$$V_{gs}\approx V_{Sig_m}-(V_{Ofs}-V_{th}) \quad (3)$$

That is, $V_{gs}$ obtained through the write processing for the drive transistor $TR_D$ depends only on the video signal $V_{Sig_m}$ for controlling the luminance of the light emitting part ELP, the threshold voltage $V_{th}$ of the drive transistor $TR_D$, and the voltage $V_{Ofs}$ for initializing the potential of the gate electrode of the drive transistor $TR_D$. Furthermore, $V_{gs}$ has no relation to the threshold voltage $V_{th\text{-}EL}$ of the light emitting part ELP.

Next, the above-described potential rise of the second node $ND_2$ in [period-TP(2)$_{6B}$] will be described below. In the driving method of the above-described reference example, in conjunction with the write processing, the mobility correction processing of raising the potential of the other source/drain region of the drive transistor $TR_D$ (i.e. the potential of the second node $ND_2$) depending on a characteristic of the drive transistor $TR_D$ (e.g. the magnitude of the mobility p) is also executed.

If the drive transistor $TR_D$ is formed of a poly-silicon thin film transistor or the like, it is difficult to avoid the occurrence of variation in the mobility $\mu$ among the transistors. Therefore, even when the video signal $V_{Sig}$ of the same value is applied to the gate electrodes of plural drive transistors $TR_D$ different from each other in the mobility $\mu$, difference arises between the drain current $I_{ds}$ that flows through the drive transistor $TR_D$ having low mobility $\mu$ and the drain current $I_{ds}$ that flows through the drive transistor $TR_D$ having high mobility $\mu$. The occurrence of such a difference spoils the evenness (uniformity) of the screen of the display device.

In the above-described driving method, the video signal $V_{Sig_m}$ is applied to the gate electrode of the drive transistor $TR_D$ in the state in which the drive voltage $V_{CC\text{-}H}$ is applied from the power supply unit 100 to one source/drain region of the drive transistor $TR_D$. Therefore, as shown in FIG. 6, the potential of the second node $ND_2$ rises in [period-TP(2)$_{6B}$]. If the value of the mobility μ of the drive transistor $TR_D$ is large, the amount ΔV of rise (potential correction value) of the potential of the other source/drain region of the drive transistor $TR_D$ (i.e. the potential of the second node $ND_2$) is large. In contrast, if the value of the mobility μ of the drive transistor $TR_D$ is small, the amount ΔV of rise (potential correction value) of the potential of the other source/drain region of the drive transistor $TR_D$ is small. The potential difference $V_{gs}$ between the gate electrode of the drive transistor $TR_D$ and the other source/drain region thereof serving as the source region is transformed from that by Formula (3) to that by the following Formula (4).

$$V_{gs} \approx V_{Sig_m} - (V_{Ofs} - V_{th}) - \Delta V \quad (4)$$

The total time ($t_0$) of the predetermined period for executing the write processing (in FIG. 6, [period-TP(2)$_{6B}$]) can be decided depending on the design of the display element and the display device. Furthermore, suppose that the total time $t_0$ of [period-TP(2)$_{6B}$] is so decided that the potential ($V_{Ofs}$−$V_{th}$+ΔV) of the other source/drain region of the drive transistor $TR_D$ at this time satisfies the following Formula (2'). The light emitting part ELP does not emit light in [period-TP(2)$_{6B}$]. By this mobility correction processing, correction of variation in the coefficient k (≡½)·(W/L)·$C_{OX}$) is also carried out simultaneously.

$$(V_{Ofs} - V_{th} + \Delta V) < (V_{th\text{-}EL} + V_{Cat}) \quad (2')$$

Figure 8E:
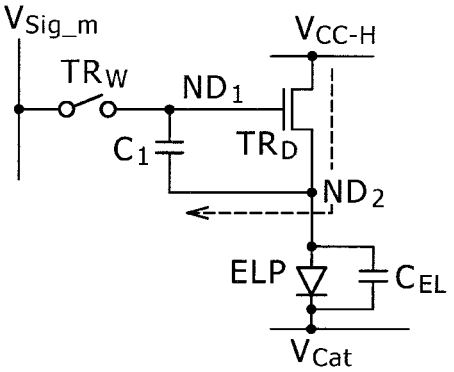

[Period-TP(2)$_{6C}$] (see FIG. 6 and FIG. 8E)

By the above-described operation, the steps from the step (a) to the step (c) are completed. Thereafter, the above-described step (d) is carried out in this [period-TP(2)$_{6C}$] and the subsequent periods. Specifically, with keeping of the application of the drive voltage $V_{CC\text{-}H}$ from the power supply unit 100 to one source/drain region of the drive transistor $TR_D$, the scan line $SCL_m$ is turned to the low level based on the operation of the scan circuit 101 to thereby switch the write transistor $TR_W$ to the off-state and set the first node $ND_1$, i.e. the gate electrode of the drive transistor $TR_D$, to the floating state. Consequently, the potential of the second node $ND_2$ rises as a result of the above-described operation.

As described above, the gate electrode of the drive transistor $TR_D$ is in the floating state, and the capacitive part $C_1$ exists. Thus, a phenomenon similar to one in a so-called bootstrap circuit occurs at the gate electrode of the drive transistor $TR_D$, so that the potential of the first node $ND_1$ also rises. As a result, the potential difference $V_{gs}$ between the gate electrode of the drive transistor $TR_D$ and the other source/drain region thereof serving as the source region keeps the value of Formula (4).

Figure 8F:
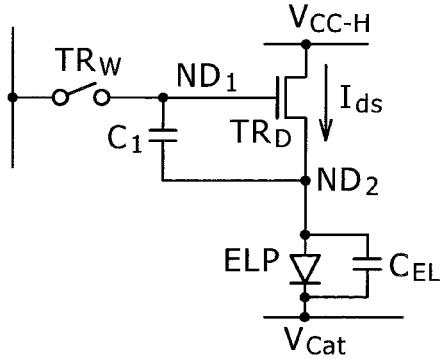

Furthermore, the potential of the second node $ND_2$ rises to surpass ($V_{th\text{-}EL}$+$V_{Cat}$), and therefore the light emitting part ELP starts to emit light (see FIG. 8F). At this time, the current that flows through the light emitting part ELP is the drain current $I_{ds}$ flowing from the drain region of the drive transistor $TR_D$ to the source region thereof, and thus can be represented by Formula (1). From Formula (1) and Formula (4), Formula (1) can be transformed into the following Formula (5).

$$I_{ds} = k \cdot \mu \cdot (V_{Sig_m} - V_{Ofs} - \Delta V)^2 \quad (5)$$

Therefore, if $V_{Ofs}$ is set to 0 volt for example, the current $I_{ds}$ flowing through the light emitting part ELP is proportional to the square of the value obtained by subtracting the potential correction value ΔV reflecting the mobility μ of the drive transistor $TR_D$ from the value of the video signal $V_{Sig_m}$ for controlling the luminance of the light emitting part ELP. In other words, the current $I_{ds}$ flowing through the light emitting part ELP does not depend on the threshold voltage $V_{th\text{-}EL}$ of the light emitting part ELP and the threshold voltage $V_{th}$ of the drive transistor $TR_D$. That is, the amount of light emission (luminance) of the light emitting part ELP is not affected by the threshold voltage $V_{th\text{-}EL}$ of the light emitting part ELP and the threshold voltage $V_{th}$ of the drive transistor $TR_D$. The luminance of the (n, m)-th display element 10 has the value dependent on this current $I_{ds}$.

In addition, when the mobility μ of the drive transistor $TR_D$ is higher, the potential correction value ΔV is larger, and thus the value of $V_{gs}$ in the left-hand side of Formula (4) is smaller. Therefore, in Formula (5), the value of $(V_{Sig_m} - V_{Ofs} - \Delta V)^2$ is small although the value of the mobility μ is large. As a result, variation in the drain current $I_{ds}$ attributed to variation in the mobility μ of the drive transistor $TR_D$ (in addition, variation in k) can be corrected. This allows correction of variation in the luminance of the light emitting part ELP attributed to the variation in the mobility μ (in addition, variation in k).

The light-emission state of the light emitting part ELP is continued until the (m+m'−1)-th horizontal scanning period. The end timing of this (m+m'−1)-th horizontal scanning period is equivalent to the end timing of [period-TP(2)$_{-1}$]. Symbol "m'" satisfies the relationship 1<m'<M and has a predetermined value in the display device. In other words, the light emitting part ELP is driven during the period from the start timing of [period-TP(2)$_{6C}$] until immediately before the (m+m')-th horizontal scanning period $H_{m+m'}$, and this period serves as the light-emission period.

Figure 9:
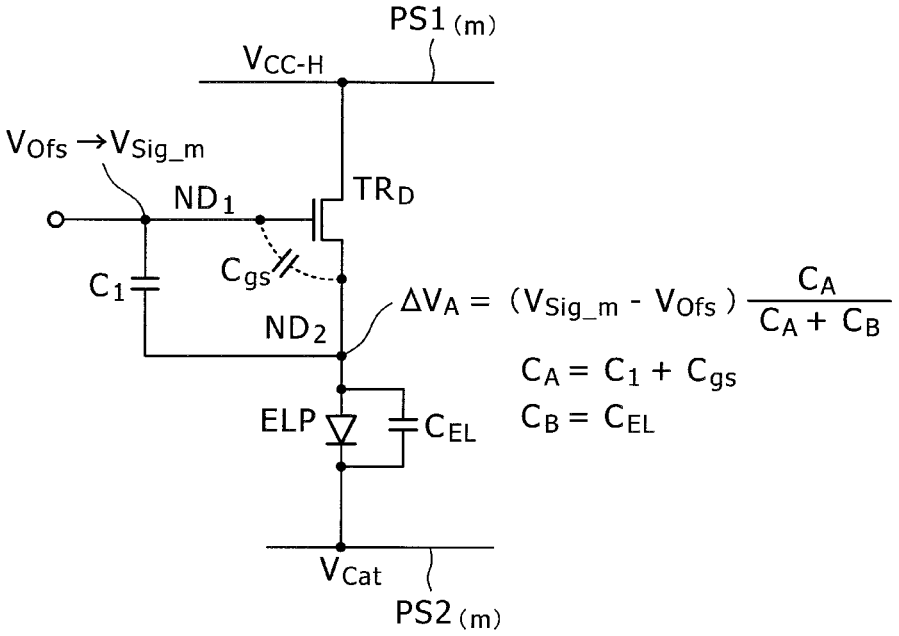
FIG. 9 is a schematic circuit diagram for explaining the potential change of a second node.

The operation in the driving method according to the reference example is described above. The potential change of the first node $ND_1$ between [period-TP(2)$_{6A}$] and [period-TP(2)$_{6B}$] is ($V_{Sig_m}$−$V_{Ofs}$). In the above description, the potential change of the second node $ND_2$ arising due to the potential change of the first node $ND_1$ is not taken into consideration. However, in practice, potential change $\Delta V_A$ given by the following Formula (6) occurs at the second node $ND_2$ as shown in FIG. 9.

$$\Delta V_A = (V_{Sig_m} - V_{Ofs}) \cdot c_A / (c_A + c_B) \quad (6)$$

Figure 10:
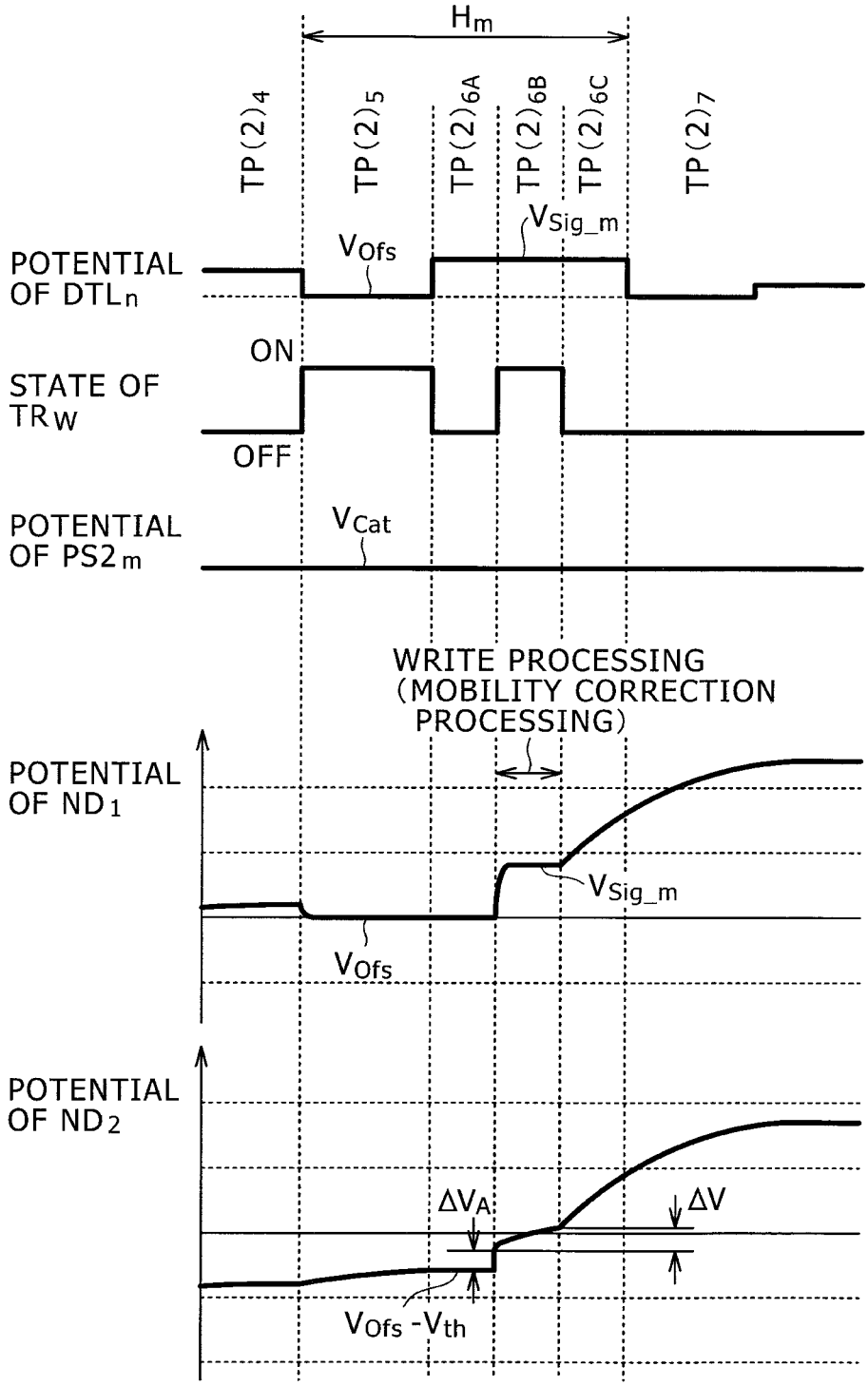
FIG. 10 is a schematic diagram for explaining the relationship among the potential of a data line, the state of a drive transistor, the potential of a second power feed line, the potential of a first node, and the potential of the second node in a horizontal scanning period $H_m$ shown in FIG. 6.

Thus, as shown in FIG. 10, the potential difference between the first node $ND_1$ and the second node $ND_2$ decreases. Consequently, the above-described Formula (5) is transformed into the following formula.

$$I_{ds} = k \cdot \mu \cdot (\alpha \cdot (V_{Sig_m} - V_{Ofs}) - \Delta V)^2 \quad (5')$$

wherein $\alpha = 1 - c_A/(c_A + c_B)$

The $c_A/(c_A+c_B)$ possibly takes a value in the range of about 0.1 to 0.4 although depending on the specifications of the display element. Therefore, the current that flows to the light emitting part ELP in [period-TP(2)$_{6C}$] and the subsequent periods decreases, and thus the luminance of the light emitting part ELP is also lowered. It may be possible to employ a countermeasure of setting the amplitude of the video signal Vsig large in advance to cover the luminance lowering. However, this countermeasure leads to a problem that increase in the power consumption is caused by the amplitude enlargement of the video signal.

In the driving method of the first embodiment, as shown in FIG. 4 and so on, in the respective periods except [period-TP(2)$_{6B}$], a first reference voltage $V_{Cat\text{-}H}$ (0 volt) is applied to the second power feed line $PS2_m$. Furthermore, in [period-TP(2)$_{6B}$], a second reference voltage $V_{Cat\text{-}L}$ (−1 volt) is applied to the second power feed line $PS2_m$. The driving method of the first embodiment is different from the driving method of the reference example in this point. The operation in the respective periods other than [period-TP(2)$_{6B}$] is substantially the same between the driving method of the first embodiment and the driving method of the reference example.

Also in the first embodiment, the above-described step (b), i.e. the threshold voltage cancel processing, is carried out over the period from [period-TP(2)$_{1B}$] to [period-TP(2)$_5$]. The first threshold voltage cancel processing is executed in [period-TP(2)$_{1B}$]. The second threshold voltage cancel processing is executed in [period-TP(2)$_3$]. The third threshold voltage cancel processing is executed in [period-TP(2)$_5$].

[Period-TP(2)$_{-1}$] to [period-TP(2)$_4$] (see FIG. 4)

The operation in these periods is substantially the same as that in the period from [period-TP(2)$_{-1}$] to [period-TP(2)$_4$] in the reference example, and therefore description thereof is omitted. Specifically, the voltage $V_{Cat}$ in the above-described operation of the reference example in these periods is replaced by the first reference voltage $V_{Cat\text{-}H}$. The operation of the drive circuit 11 is the same as that carried out with replacement of sign $V_{Cat}$ by sign $V_{Cat\text{-}H}$ in FIGS. 7A to 7F and FIG. 8A.

Figure 11A:
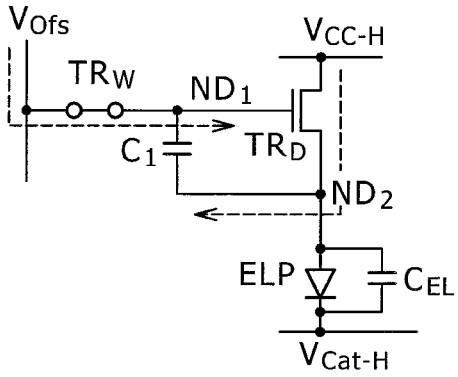
FIGS. 11A to 11E are diagrams schematically showing the on/off-states of the respective transistors and so on in the drive circuit in the display element.

[Period-TP(2)$_5$] (see FIG. 4 and FIG. 11A)

At the start timing of this [period-TP(2)$_5$], the voltage of the data line $DTL_n$ is switched from the video signal $V_{Sig_m-1}$ to the first node initialization voltage $V_{Ofs}$. At the start timing of this [period-TP(2)$_5$], the write transistor $TR_W$ is turned to the on-state by the signal from the scan line $SCL_m$. The first node $ND_1$ becomes the state in which the first node initialization voltage $V_{Ofs}$ is applied thereto from the data line $DTL_n$ via the write transistor $TR_W$ with the first reference voltage $V_{Cat\text{-}H}$ applied from the second power feed line PS2$_m$ to the cathode electrode included in the light emitting part ELP. Thereby, the third threshold voltage cancel processing is executed.

The potential of the second node $ND_2$ changes toward the potential obtained by subtracting the threshold voltage $V_{th}$ of the drive transistor $TR_D$ from the potential of the first node $ND_1$. If the potential difference between the gate electrode of the drive transistor $TR_D$ and the other source/drain region thereof reaches $V_{th}$, the drive transistor $TR_D$ enters the off-state. In this state, the potential of the second node $ND_2$ is substantially ($V_{Ofs}-V_{th}$). The operation in this period is substantially the same as the operation in the driving method of the reference example.

Figure 11B:
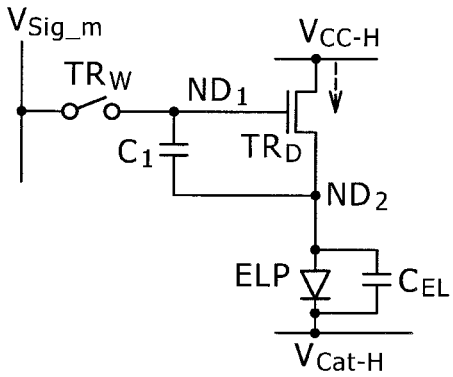

[Period-TP(2)$_{6A}$] (see FIG. 6 and FIG. 11B)

At the start timing of this [period-TP(2)$_{6A}$], the write transistor $TR_W$ is turned to the off-state by the scan signal from the scan line $SCL_m$. The first reference voltage $V_{Cat\text{-}H}$ is continuously applied from the second power feed line PS2$_m$ to the cathode electrode included in the light emitting part ELP. The operation in this period is substantially the same as the operation in the driving method of the reference example.

Figure 11C:
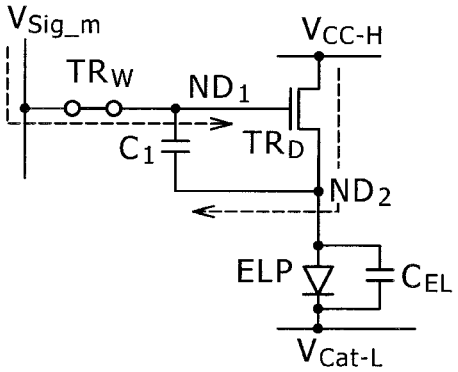
Figure 11D:
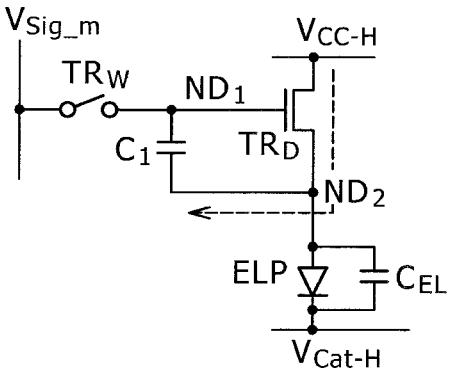
Figure 11E:
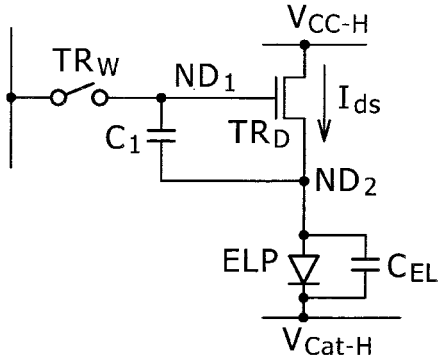

[Period-TP(2)$_{6B}$] (see FIG. 6 and FIG. 11C)

In this period, the write processing is executed in the state in which the second reference voltage $V_{Cat\text{-}L}$ lower than the first reference voltage $V_{Cat\text{-}H}$ is applied from the second power feed line PS2$_m$ to the cathode electrode. Specifically, at the start timing of this period, the voltage applied to the second power feed line PS2$_m$ is switched from the first reference voltage $V_{Cat\text{-}H}$ to the second reference voltage $V_{Cat\text{-}L}$. Furthermore, the write transistor $TR_W$ is turned to the on-state by the scan signal from the scan line $SCL_m$. Via the write transistor $TR_W$, the video signal $V_{Sig_m}$ is applied from the data line $DTL_n$ to the first node $ND_1$. As a result, the potential of the first node $ND_1$ rises to $V_{Sig_m}$.

Figure 12:
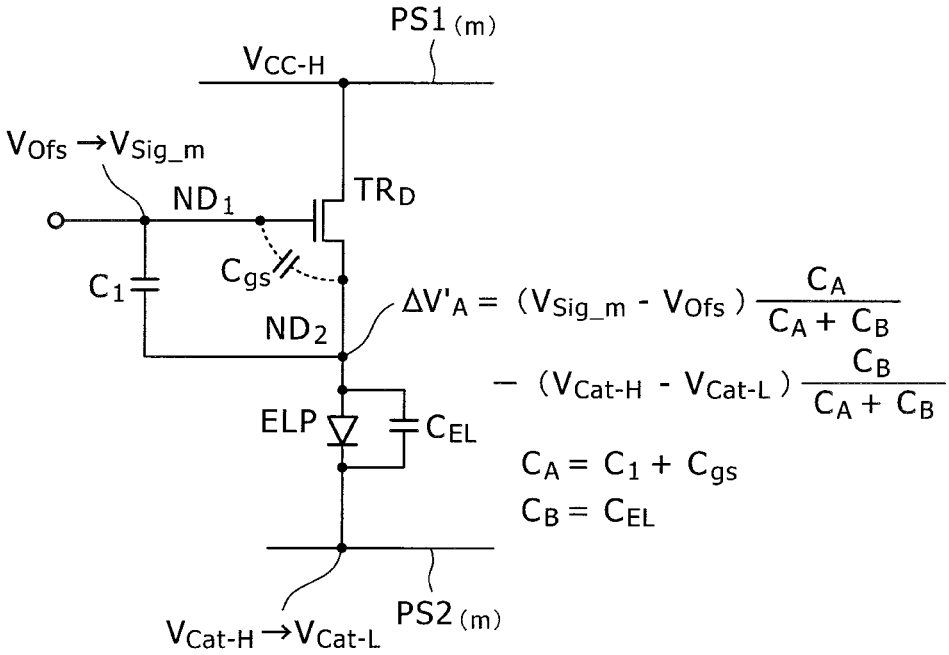
FIG. 12 is a schematic circuit diagram for explaining the potential change of the second node.

Similarly to the reference example, the potential change of the first node $ND_1$ between [period-TP(2)$_{6A}$] and [period-TP(2)$_{6B}$] is ($V_{Sig_m}-V_{Ofs}$). However, in the first embodiment, the voltage of the second power feed line PS2$_m$ also changes between [period-TP(2)$_{6A}$] and [period-TP(2)$_{6B}$]. Thus, as shown in FIG. 12, potential change $\Delta V_A'$ given by the following Formula (7) occurs at the second node $ND_2$.

$$\Delta V_A'=(V_{Sig_m}-V_{Ofs})\cdot c_A/(c_A+c_B)-(V_{Cat\text{-}H}-V_{Cat\text{-}L})\cdot c_B/(c_A+c_B)=\Delta V_A-(V_{Cat\text{-}H}-V_{Cat\text{-}L})\cdot c_B/(c_A+c_B) \quad (7)$$

If this Formula (7) is solved with substitution of $\Delta V_A'=0$, the following Formula (8) is obtained.

$$V_{Cat\text{-}H}-V_{Cat\text{-}L}=(V_{Sig_m}-V_{Ofs})\cdot c_A/c_B \quad (8)$$

As is apparent from Formula (7), $\Delta V_A'$ is smaller than $\Delta V_A$. Furthermore, according to Formula (8), $\Delta V_A'$ can be set to 0 volt if the difference between the first reference voltage $V_{Cat\text{-}H}$ and the second reference voltage $V_{Cat\text{-}L}$ is set equal to $(V_{Sig_m}-V_{Ofs})\cdot c_A/c_B$. However, the second power feed line PS2$_m$ is common to N display elements 10 forming the m-th row, and the video signal $V_{Sig}$ applied to N display elements 10 on the m-th row has an individual value for each display element 10. Therefore, it is impossible to set $\Delta V_A'$ to 0 volt for all of these display elements 10. In the first embodiment, the first reference voltage $V_{Cat\text{-}H}$ and the second reference voltage $V_{Cat\text{-}L}$ are set on the basis of the intermediate value of the video signal $V_{Sig}$.

Specifically, the maximum value that is possibly taken by the video signal $V_{Sig}$ is represented as $V_{Sig_Max}$ (in the first embodiment, 7 volts), and the minimum value that is possibly taken by the video signal $V_{Sig}$ is represented as $V_{Sig_Min}$ (in the first embodiment, 1 volt). As described above, the capacitance between the first node $ND_1$ and the second node $ND_2$ is represented as $c_A$, and the capacitance between the second node $ND_2$ and the second power feed line PS2$_m$ is represented as $c_B$. In addition, the voltage applied to the first node $ND_1$ for keeping the potential of the first node $ND_1$ in the threshold voltage cancel processing is represented as $V_{Ofs}$. The first reference voltage $V_{Cat\text{-}H}$ and the second reference voltage $V_{Cat\text{-}L}$ are set based on the following Formula (9). In the first embodiment, the relationship $c_A:c_B=1:4$ is employed.

$$V_{Cat\text{-}H}-V_{Cat\text{-}L}=(V_{Sig_Max}+V_{Sig_Min})/2-V_{Ofs})\cdot c_A/c_B \quad (9)$$

Figure 13:
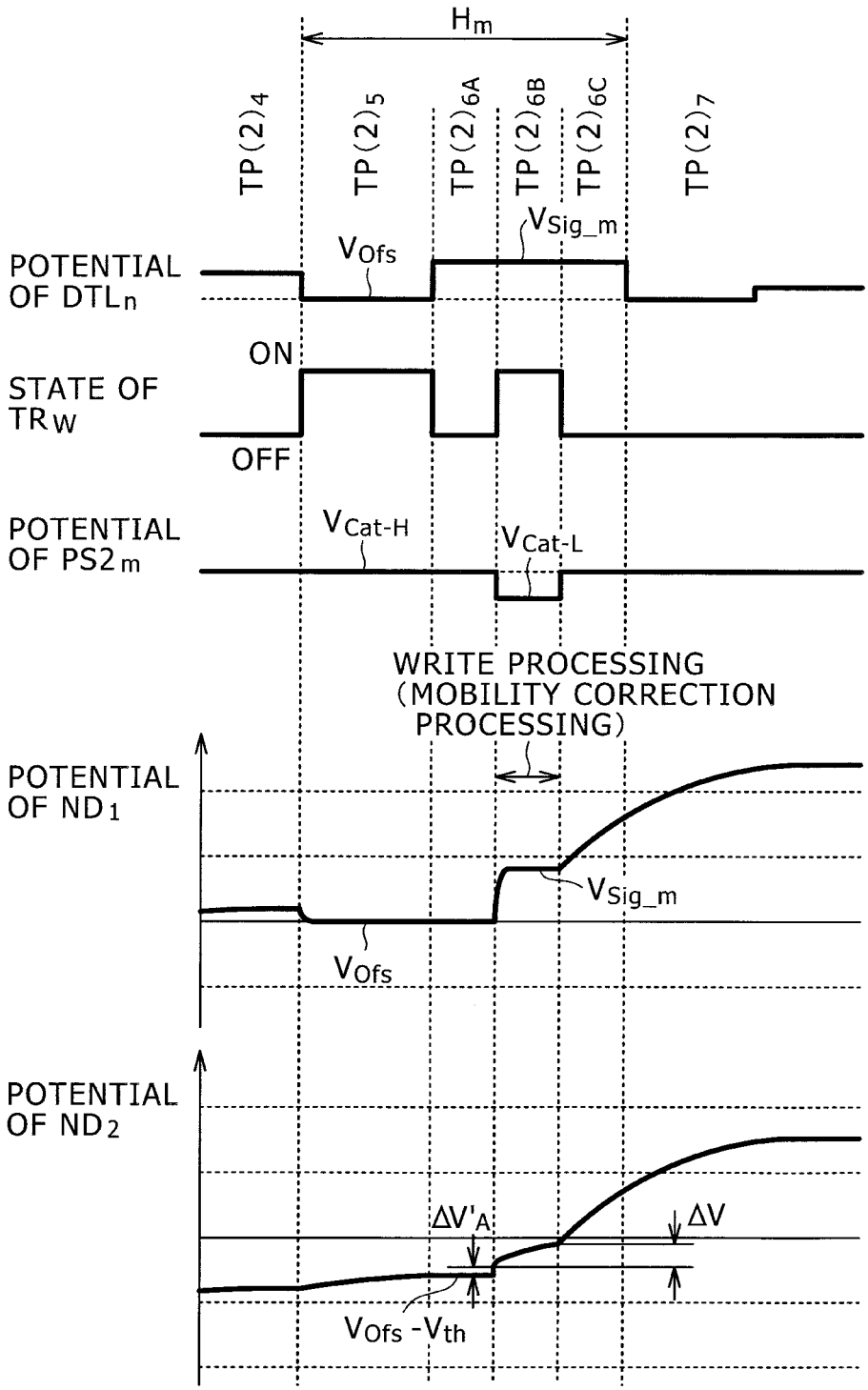
FIG. 13 is a schematic diagram for explaining the relationship among the potential of a data line, the state of a drive transistor, the potential of a second power feed line, the potential of a first node, and the potential of the second node in a horizontal scanning period $H_m$ shown in FIG. 4.

The operation in the driving method according to the first embodiment is described above. The potential change of the second node $ND_2$ between [period-TP(2)$_{6A}$] and [period-TP(2)$_{6B}$] is $\Delta V_A'$, which is smaller than $\Delta V_A$ in the reference example. Thus, as shown in FIG. 13, the potential change of the second node $ND_2$ arising due to the potential change of the first node $ND_1$ between [period-TP(2)$_{6A}$] and [period-TP(2)$_{6B}$] can be suppressed.

In the above description, the voltage of the second power feed line PS2$_m$ is set to the first reference voltage $V_{Cat\text{-}H}$ in the respective periods except [period-TP(2)$_{6B}$]. However, for example, it is also possible to employ a configuration in which the voltage of the second power feed line PS2$_m$ is kept at the second reference voltage $V_{Cat\text{-}L}$ in [period-TP (2)$_{6C}$] and [period-TP(2)$_7$]. Alternatively, for example, it is also possible to employ a configuration in which the voltage of the second power feed line PS2$_m$ is set to the second reference voltage $V_{Cat\text{-}L}$ in [period-TP(2)$_{6A}$] and [period-TP(2)$_{6A}$] and the voltage of the second power feed line PS2$_m$ is set to the first reference voltage $V_{Cat\text{-}H}$ in the other periods. Basically, any configuration is possible as long as the voltage of the second power feed line PS2$_m$ is the first reference voltage $V_{Cat\text{-}H}$ during the period when the threshold voltage cancel processing immediately before the execution of the write processing is executed and the voltage of the second power feed line PS2$_m$ is the second reference voltage $V_{Cat\text{-}L}$ during the period when the write processing is executed. In the other periods, as long as the operation is not obstructed, the voltage of the second power feed line $PS2_m$ may be any of the first reference voltage $V_{Cat-H}$, the second reference voltage $V_{Cat-L}$, and voltage of further another value.

Second Embodiment

The second embodiment relates to the method for driving a display element according to the first form of the present invention and the method for driving a display device according to the third form of the present invention.

FIG. 14 shows a display device used in the second embodiment. As described above, this display device has the same configuration as that of the display device used in the first embodiment except for that the second power feed line $PS2_m$ is a common power feed line. The common second power feed line $PS2_m$ is connected to the cathode voltage control circuit 103.

In the first embodiment, the voltage needs to be changed only in [period-TP$(2)_{6B}$] as shown in FIG. 4. Therefore, the second power feed line PS2 needs to be independently formed on a row-by-row basis and the applied voltage needs to be individually controlled so that the voltage applied to the second power feed line PS2 can be individually controlled on a row-by-row basis.

In the second embodiment, the second power feed line PS2 is formed as a common power feed line. Therefore, the second reference voltage $V_{Cat-L}$ is applied to the common second power feed line PS2 in the periods equivalent to [period-TP$(2)_{6B}$] of each row, and the first reference voltage $V_{Cat-H}$ is applied to the common second power feed line PS2 in the other periods.

Figure 15:
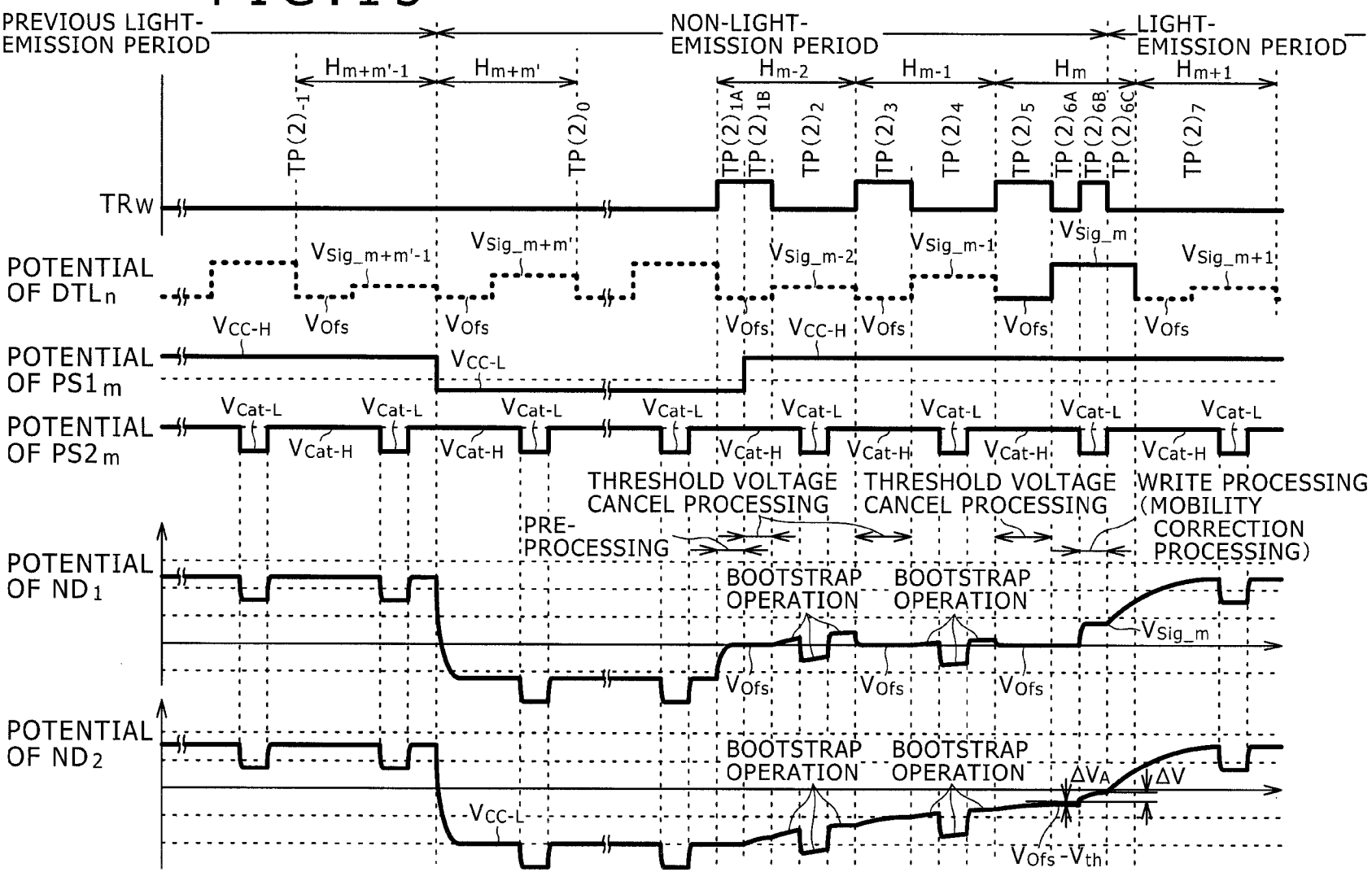
FIG. 15 is a schematic diagram of a timing chart of driving of a display element according to the second embodiment.

A timing chart of driving of the display element 10 according to the second embodiment is schematically shown in FIG. 15. As is apparent from comparison with FIG. 4, the second reference voltage $V_{Cat-L}$ is applied to the common second power feed line PS2 in the periods equivalent to [period-TP$(2)_{6B}$] of each row, during which the video signal $V_{Sig}$ is applied to the data line $DTL_n$, and the first reference voltage $V_{Cat-H}$ is applied to the common second power feed line PS2 in the other periods.

Therefore, in linkage with the change in the voltage applied to the common second power feed line PS2, the potential of the anode electrode of the light emitting part ELP also changes in the periods equivalent to [period-TP$(2)_{6B}$] of each row. The driving method of the second embodiment is different from the driving method of the first embodiment in the above-described point. However, the potential of the anode electrode of the light emitting part ELP changes at timings that do not overlap with the periods of the threshold voltage cancel processing. Except for the above-described point, the operation in the respective periods shown in FIG. 15 is the same as that described for the first embodiment. Furthermore, the potentials of the first node $ND_1$ and the second node $ND_2$ also change in such a manner as to follow the potential change of the anode electrode of the light emitting part ELP. Therefore, the operation is not obstructed in the initialization, the threshold voltage cancel processing, the write processing, and so on.

As above, in the second embodiment, the second power feed line PS2 can be formed as a common power feed line, and there is no need to control the timings of the application of the first reference voltage and the second reference voltage on a row-by-row basis. Therefore, the second embodiment has an advantage over the first embodiment in that the configuration of the display device can be more simplified.

The present invention is described above based on the preferred embodiments. However, the present invention is not limited to the embodiments. The configurations and structures of the display devices and the display element and the steps in the methods for driving the display element and the display devices described for the embodiments are examples and can be accordingly changed.

For example, the capacitance between the second node and the second power feed line changes due to change in the light emitting part over time in some cases. In such a case, e.g. a configuration in which the values of the first reference voltage and the second reference voltage are changed depending on the operation time of the display device and so on makes it possible to respond to the change in the capacitance between the second node and the second power feed line over time.

Figure 16:
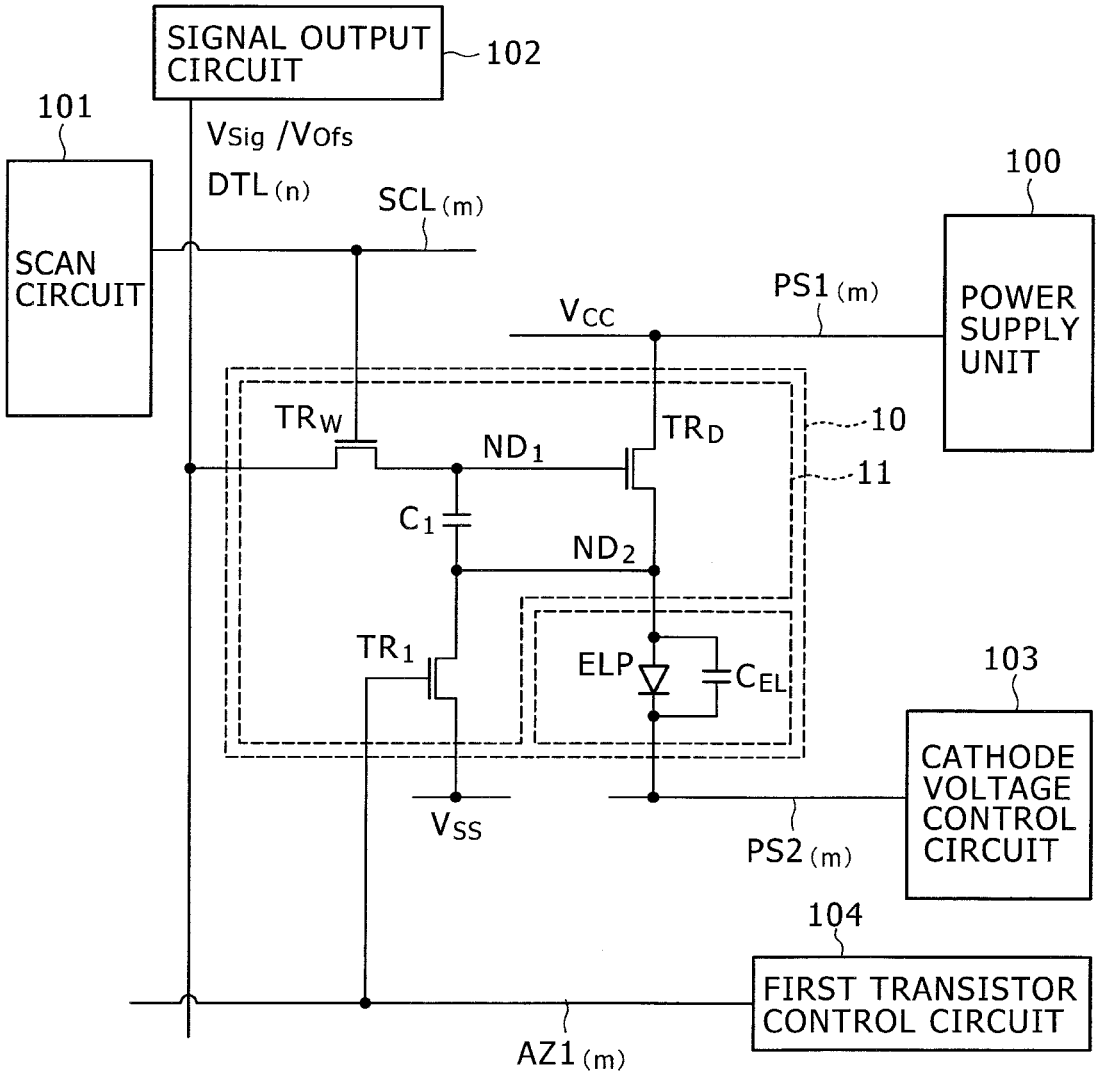
FIG. 16 is an equivalent circuit diagram of a display element including a drive circuit.

For example, as shown in FIG. 16, the drive circuit 11 in the display element 10 may include a transistor (first transistor $TR_1$) connected to the second node $ND_2$. For the first transistor $TR_1$, a second node initialization voltage $V_{SS}$ is applied to one source/drain region, and the other source/drain region is connected to the second node $ND_2$. A signal from a first transistor control circuit 104 is applied to the gate electrode of the first transistor $TR_1$ via a first transistor control line AZ1, and the on/off-state of the first transistor $TR_1$ is controlled. This allows setting of the potential of the second node $ND_2$.

Figure 17:
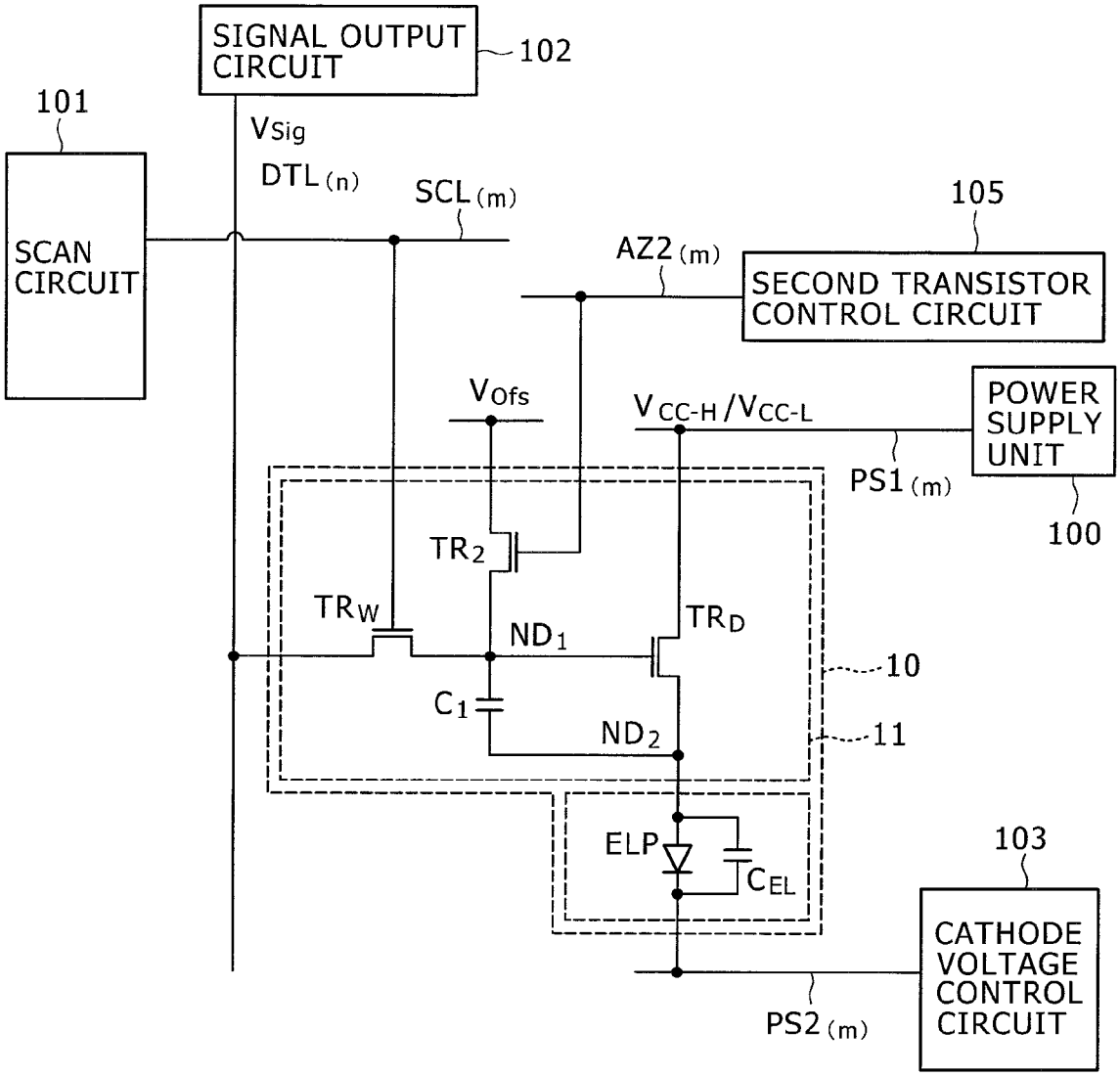
FIG. 17 is an equivalent circuit diagram of a display element including a drive circuit.

Alternatively, as shown in FIG. 17, the drive circuit 11 in the display element 10 may include a transistor (second transistor $TR_2$) connected to the first node $ND_1$. For the second transistor $TR_2$, the first node initialization voltage $V_{Ofs}$ is applied to one source/drain region, and the other source/drain region is connected to the first node $ND_1$. A signal from a second transistor control circuit 105 is applied to the gate electrode of the second transistor $TR_2$ via a second transistor control line AZ2, and the on/off-state of the second transistor $TR_2$ is controlled. This allows setting of the potential of the first node $ND_1$.

Figure 18:
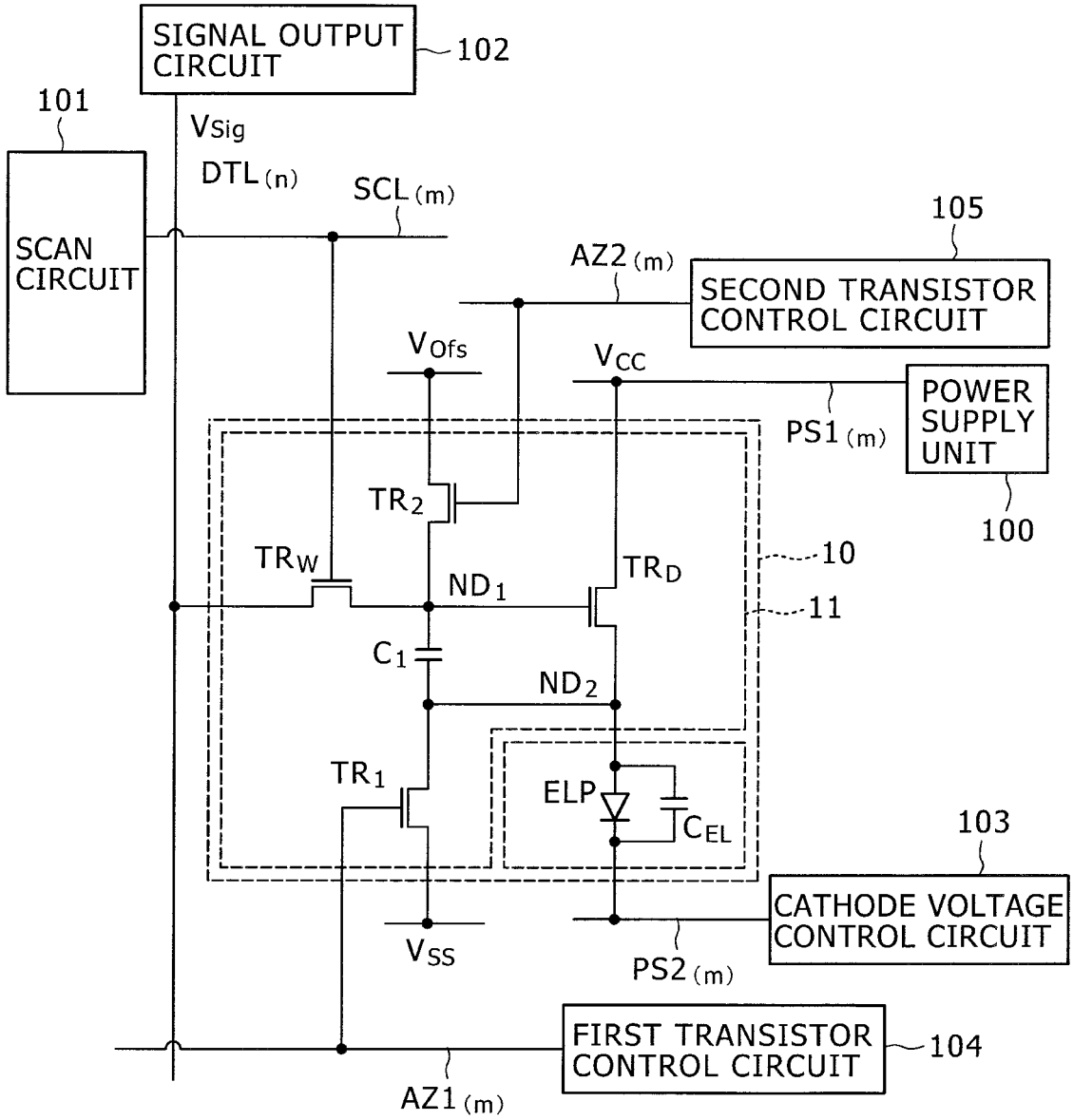
FIG. 18 is an equivalent circuit diagram of a display element including a drive circuit.

Moreover, as shown in FIG. 18, the drive circuit 11 in the display element 10 may have both of the above-described first transistor $TR_1$ and second transistor $TR_2$. Furthermore, it is also possible to employ a configuration including another transistor in addition to these transistors.

The present application contains subject matter related to that disclosed in Japanese Priority Patent Application JP 2009-089063 filed in the Japan Patent Office on Apr. 1, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A method for driving a display element including a current-driven light emitting part and a drive circuit, the drive circuit including a write transistor, a drive transistor, and a capacitive part, in the display element, (A-1) one source/drain region of the drive transistor being connected to a first power feed line, (A-2) the other source/drain region of the drive transistor being connected to an anode electrode included in the light emitting part and one electrode of the capacitive part, and forming a second node, (A-3) a gate electrode of the drive transistor being connected to the other source/drain region of the write transistor and the other electrode of the capacitive part, and forming a first node, (B-1) one source/drain region of the write transistor being connected to a data line, (B-2) a gate electrode of the write transistor being connected to a scan line, and (C-1) a cathode electrode included in the light emitting part being connected to a second power feed line, the method comprising the steps of:

executing threshold voltage cancel processing of changing potential of the second node toward potential obtained by subtracting threshold voltage of the drive transistor from potential of the first node in a state in which the potential of the first node is kept; and executing write processing of applying a video signal from the data line to the first node via the write transistor turned to an on-state by a scan signal from the scan line, wherein the threshold voltage cancel processing is executed in a state in which a first reference voltage is applied from the second power feed line to the cathode electrode included in the light emitting part, and subsequently the write processing is executed in a state in which a second reference voltage lower than the first reference voltage is applied from the second power feed line to the cathode electrode.

2. The method for driving a display element according to claim 1, wherein an equation $V_{Cat\text{-}H}-V_{Cat\text{-}L}=((V_{Sig_Max}+V_{Sig_Min})/2-V_{Ofs})\cdot c_A/c_B$ holds if $V_{Cat\text{-}H}$ denotes the first reference voltage, $V_{Cat\text{-}L}$ denotes the second reference voltage, $V_{Sig_Max}$ denotes a maximum value that is possibly taken by the video signal, $V_{Sig_Min}$ denotes a minimum value that is possibly taken by the video signal, $c_A$ denotes capacitance between the first node and the second node, $c_B$ denotes capacitance between the second node and the second power feed line, and $V_{Ofs}$ denotes voltage applied to the first node for keeping the potential of the first node in the threshold voltage cancel processing.

3. The method for driving a display element according to claim 1, wherein pre-processing of initializing the potential of the first node and the potential of the second node is executed so that potential difference between the first node and the second node surpasses the threshold voltage of the drive transistor and potential difference between the second node and the cathode electrode included in the light emitting part does not surpass threshold voltage of the light emitting part, subsequently, the threshold voltage cancel processing is executed, thereafter, the write processing is executed, and subsequently, the first node is turned to a floating state by switching the write transistor to an off-state by the scan signal from the scan line, and the light emitting part is driven by making a current dependent on the potential difference between the first node and the second node flow through the light emitting part via the drive transistor in a state in which predetermined drive voltage is applied from the first power feed line to one source/drain region of the drive transistor.

4. The method for driving a display element according to claim 1, wherein the light emitting part is formed of an organic electroluminescence light emitting part.

5. A method for driving a display device including (1) N×M display elements that are arranged in a two-dimensional matrix in such a way that N display elements are arranged along a first direction and M display elements are arranged along a second direction different from the first direction, and each include a current-driven light emitting part and a drive circuit, (2) M scan lines extending along the first direction, (3) N data lines extending along the second direction, (4) M first power feed lines extending along the first direction, and (5) M second power feed lines extending along the first direction, the drive circuit including a write transistor, a drive transistor, and a capacitive part, in the display element on an m-th row (m=1, 2, . . . , and M) and an n-th column (n=1, 2, . . . , and N), (A-1) one source/drain region of the drive transistor being connected to an m-th first power feed line, (A-2) the other source/drain region of the drive transistor being connected to an anode electrode included in the light emitting part and one electrode of the capacitive part, and forming a second node, (A-3) a gate electrode of the drive transistor being connected to the other source/drain region of the write transistor and the other electrode of the capacitive part, and forming a first node, (B-1) one source/drain region of the write transistor being connected to an n-th data line, (B-2) a gate electrode of the write transistor being connected to an m-th scan line, and (C-1) a cathode electrode included in the light emitting part being connected to an m-th second power feed line, the method comprising the steps of:

executing threshold voltage cancel processing of changing potential of the second node toward potential obtained by subtracting threshold voltage of the drive transistor from potential of the first node in a state in which the potential of the first node is kept; and executing write processing of applying a video signal from the data line to the first node via the write transistor turned to an on-state by a scan signal from the scan line, wherein the threshold voltage cancel processing is executed in a state in which a first reference voltage is applied from the second power feed line to the cathode electrode included in the light emitting part, and subsequently the write processing is executed in a state in which a second reference voltage lower than the first reference voltage is applied from the second power feed line to the cathode electrode.

6. A method for driving a display device including (1) N×M display elements that are arranged in a two-dimensional matrix in such a way that N display elements are arranged along a first direction and M display elements are arranged along a second direction different from the first direction, and each include a current-driven light emitting part and a drive circuit, (2) M scan lines extending along the first direction, (3) N data lines extending along the second direction, (4) M first power feed lines extending along the first direction, and (5) a common second power feed line, the drive circuit including a write transistor, a drive transistor, and a capacitive part, in the display element on an m-th row (m=1, 2, . . . , and M) and an n-th column (n=1, 2, . . . , and N), (A-1) one source/drain region of the drive transistor being connected to an m-th first power feed line, (A-2) the other source/drain region of the drive transistor being connected to an anode electrode included in the light emitting part and one electrode of the capacitive part, and forming a second node, (A-3) a gate electrode of the drive transistor being connected to the other source/drain region of the write transistor and the other electrode of the capacitive part, and forming a first node, (B-1) one source/drain region of the write transistor being connected to an n-th data line, (B-2) a gate electrode of the write transistor being connected to an m-th scan line, and (C-1) a cathode electrode included in the light emitting part being connected to the common second power feed line, the method comprising the steps of:

executing threshold voltage cancel processing of changing potential of the second node toward potential obtained by subtracting threshold voltage of the drive transistor from potential of the first node in a state in which the potential of the first node is kept; and executing write processing of applying a video signal from the data line to the first node via the write transistor turned to an on-state by a scan signal from the scan line, wherein the threshold voltage cancel processing is executed in a state in which a first reference voltage is applied from the second power feed line to the cathode electrode included in the light emitting part, and subsequently the write processing is executed in a state in which a second reference voltage lower than the first reference voltage is applied from the second power feed line to the cathode electrode.

* * * * *